US008371072B1

(12) United States Patent
Shanes et al.

(10) Patent No.: US 8,371,072 B1
(45) Date of Patent: Feb. 12, 2013

(54) MOLDED SYNTHETIC HIP, RIDGE OR RAKE SHINGLE AND PROCESS AND APPARATUS FOR MOLDING SAME

(75) Inventors: Larry Wayne Shanes, Wake Forest, NC (US); Thomas Kevin MacKinnon, Daniel Island, SC (US)

(73) Assignee: CertainTeed Corporation, Valley Forge, PA (US)

( * ) Notice: Subject to any disclaimer, the term of this patent is extended or adjusted under 35 U.S.C. 154(b) by 107 days.

(21) Appl. No.: 12/550,485

(22) Filed: Aug. 31, 2009

Related U.S. Application Data

(60) Provisional application No. 61/099,330, filed on Sep. 23, 2008.

(51) Int. Cl.
*E04B 7/02* (2006.01)
*E04B 7/00* (2006.01)

(52) U.S. Cl. ..... 52/43; 52/519; 52/90.1; 52/41; 52/42; D25/139

(58) Field of Classification Search ..... 52/57, 198, 52/276, 278, 518–560, 90.1–93.1, 40–43, 52/199; D25/138–143, 119, 124, 102, 106, D25/148, 150, 152–155, 199
See application file for complete search history.

(56) References Cited

U.S. PATENT DOCUMENTS

| | | | | | |
|---|---|---|---|---|---|
| 2,348,433 | A | * | 5/1944 | Guerci | 425/303 |
| 3,016,040 | A | * | 1/1962 | Crookston, Jr. | 118/410 |
| 4,068,422 | A | * | 1/1978 | Sumner | 52/81.2 |
| 4,924,761 | A | * | 5/1990 | MacLeod et al. | 454/365 |
| D366,336 | S | * | 1/1996 | Noone et al. | D25/139 |
| 5,711,126 | A | * | 1/1998 | Wells | 52/519 |
| 6,351,913 | B1 | * | 3/2002 | Freiborg et al. | 52/57 |
| 7,178,294 | B2 | * | 2/2007 | Jolitz | 52/43 |
| D603,981 | S | * | 11/2009 | King | D25/139 |
| D617,913 | S | * | 6/2010 | Shanes et al. | D25/139 |
| D625,845 | S | * | 10/2010 | Shanes et al. | D25/139 |
| D636,501 | S | * | 4/2011 | Shanes et al. | D25/139 |
| 2006/0029775 | A1 | | 2/2006 | MacKinnon et al. | |

FOREIGN PATENT DOCUMENTS

WO W02009023038 A2 2/2009

OTHER PUBLICATIONS

CertainTeed Symphony Installation Instructions. Published Feb./Mar. 2008.

* cited by examiner

*Primary Examiner* — Jeanette E. Chapman
(74) *Attorney, Agent, or Firm* — Paul & Paul

(57) ABSTRACT

A molded hip, ridge or rake shingle is provided that is shaped to fit over angled intersecting planar surface of a roof hip, ridge or rake, by making a shingle precursor and draping it in heated condition over a rack having surfaces that have an included angle therebetween to cool and take form, such that portions of the shingle precursor conform to the surfaces of the rack, at a desired predetermined included angle between the shingle precursor portions, to form a hip, ridge or rake shingle with shingle portions having the desired included angle between the shingle portions. The shingle is formed according to the process, and on an apparatus, to produce the shingles that can be applied to a roof, in an array of shingles.

9 Claims, 19 Drawing Sheets

Fig. 2C
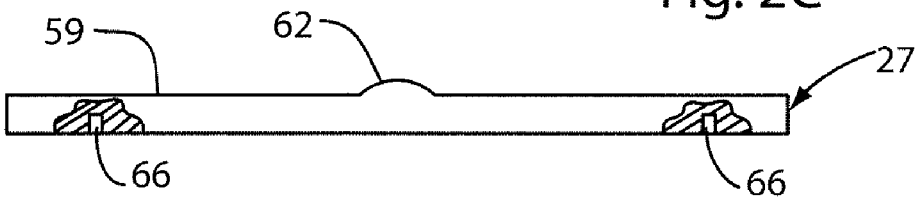
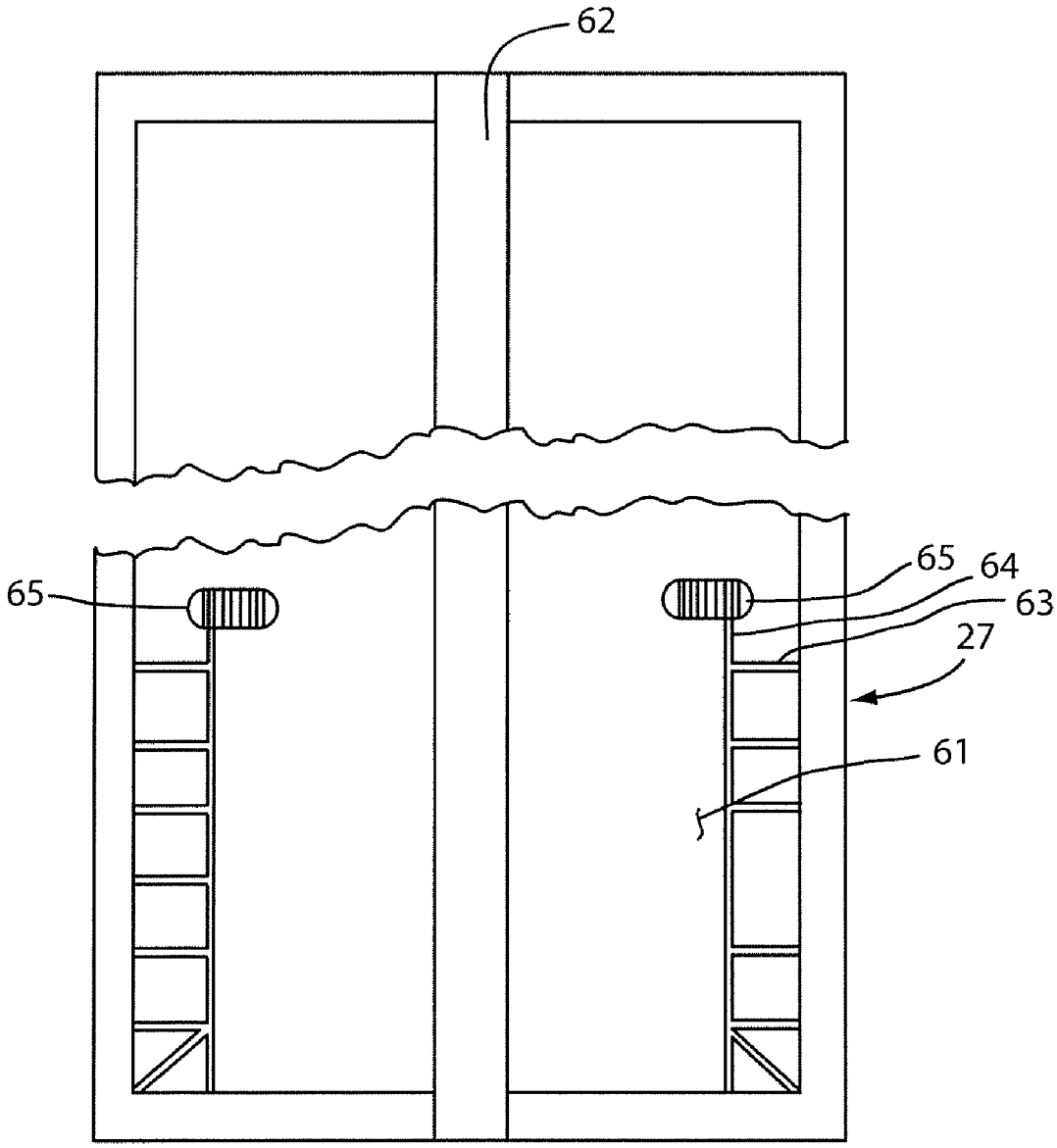
Fig. 2B

MOLDED SYNTHETIC HIP, RIDGE OR RAKE SHINGLE AND PROCESS AND APPARATUS FOR MOLDING SAME

CROSS-REFERENCE TO RELATED APPLICATIONS

This application is based upon U.S. provisional application 61/099,330, filed Sep. 23, 2008, from which this application claims priority.

BACKGROUND OF THE INVENTION

In the art of shingle manufacture, it is known to produce shingles of natural materials, such as slate, cedar shakes, and tiles, all for use on roofs, to give a rich, highly aesthetic appearance to the roofs of homes or other buildings.

Generally, the use of natural materials has become very expensive. Additionally, the use of natural materials in many instances, such as slate shingles or tiles, can greatly increase the weight applied to a roof, often requiring additional support for the roof, which again can increase the expense of a roof.

Accordingly, there has developed the use of synthetic materials which can be molded or otherwise formed, to give the appearance of natural materials, but which can be lighter in weight than the natural materials they are designed to simulate.

In some such developments, such as in U.S. Patent Publication No. 2006/0029775, and PCT/US07/085,900 the complete disclosure of which are herein incorporated by reference, short cycle molding techniques are addressed, for shortening molding time.

SUMMARY OF INVENTION

A molded hip, ridge, or rake shingle is provided, shaped to fit over angled intersecting planar surfaces of a roof hip, ridge or rake and a process and apparatus for making such a shingle is provided.

Shingle material preferably comprising a core material and a capstock material is extruded onto a series of carrier plates, which, preferably, have been pre-heated. The shingle material is severed between each carrier plate, and the carrier plates with the shingle material are then delivered to a compression mold so that the entire process is of the short cycle type, wherein the surface configuration that is desired is molded into the shingle material to form a shingle precursor. The shingle precursor thus formed is separated from the carrier plate and placed on a secondary plate, where flashing remaining from the molding operation and optionally other shingle material is cut away. The shingle precursor thus formed is placed on a support rack and heated so that the overall shape of the shingle precursor conforms to the shape of the rack. The shingle precursor is then cooled, either in the zone of the support rack, or alternatively, is delivered to a cooling zone, in each case where the bent shape becomes "set" or permanent.

The rack has a shape such that the radius of the bend varies from the upper or headlap portion of the shingle precursor to the lower exposure or finished look or tab portion of the shingle. The internal radius or the internal angle is tighter in the upper end of the headlap portion than at the lower end of the tab portion of the shingle precursor. Generally, the internal angle or radius of the finished end of the shingle is such that it matches the exterior radius of the shingle thus formed, about halfway along the length of the shingle precursor. Because of the variable radius of the bend along the length of the shingle precursor, an overlying shingle, thus formed, in an array of such shingles when installed on a roof, fits snuggly nested over an underlying shingle on a hip, ridge or rake. This also helps in alignment and placement of shingles along a hip, ridge or rake during installation because they fit together well in the optimal configuration on the roof.

The resultant cooled shingle with the bent shape is then adapted to be fastened to a roof hip, ridge or rake.

Because the shingle material is still somewhat soft when it is being molded in the compression mold, by using a carrier plate to carry such material while it is in the compression mold, the duration of the shingle material in the compression mold may be shortened. Additionally, by having a surface configuration to the carrier plate that is the reciprocal of the surface configuration of the shingle, it is not necessary that the mold itself have a supporting surface beneath the shingle that is being molded, that is a reciprocal surface configuration for the adjacent surface of the roofing shingle. Thus, the carrier plate becomes the bottom of the mold during compression molding. The carrier plate also allows for automation and handling of the part.

It is an object of the present invention to provide a molded synthetic hip, ridge or rake shingle and a process and apparatus for molding the shingle.

It is yet another object of this invention to provide a method and apparatus for applying a bend or curvature to shingles as they are cooling, following the molding thereof.

It is a further object of this invention to accomplish the above object, wherein the molded shingle precursor is shaped to a predetermined curvature by heating it while it is disposed over a shaped rack.

It is another object of this invention to accomplish the above object, with means and apparatus for cooling the shingle thus formed, to maintain its shape.

Other objects and advantages of the present invention will be readily apparent from a reading of the following brief descriptions of the drawing figures, the detailed descriptions of the preferred embodiments, and the appended claims.

BRIEF DESCRIPTIONS OF THE DRAWING FIGURES

FIG. 2B is fragmentary a top view of a carrier plate for receiving extruded shingle material thereon, for carrying the shingle material to and during a compression molding of the shingle material into a shingle.

FIG. 2C is a side elevational view of the carrier plate of FIG. 2B, with portions broken away and illustrated in section, to illustrate positioning holes for receiving positioning pins therein for aligning each carrier plate in a compression mold.

Figure 9:
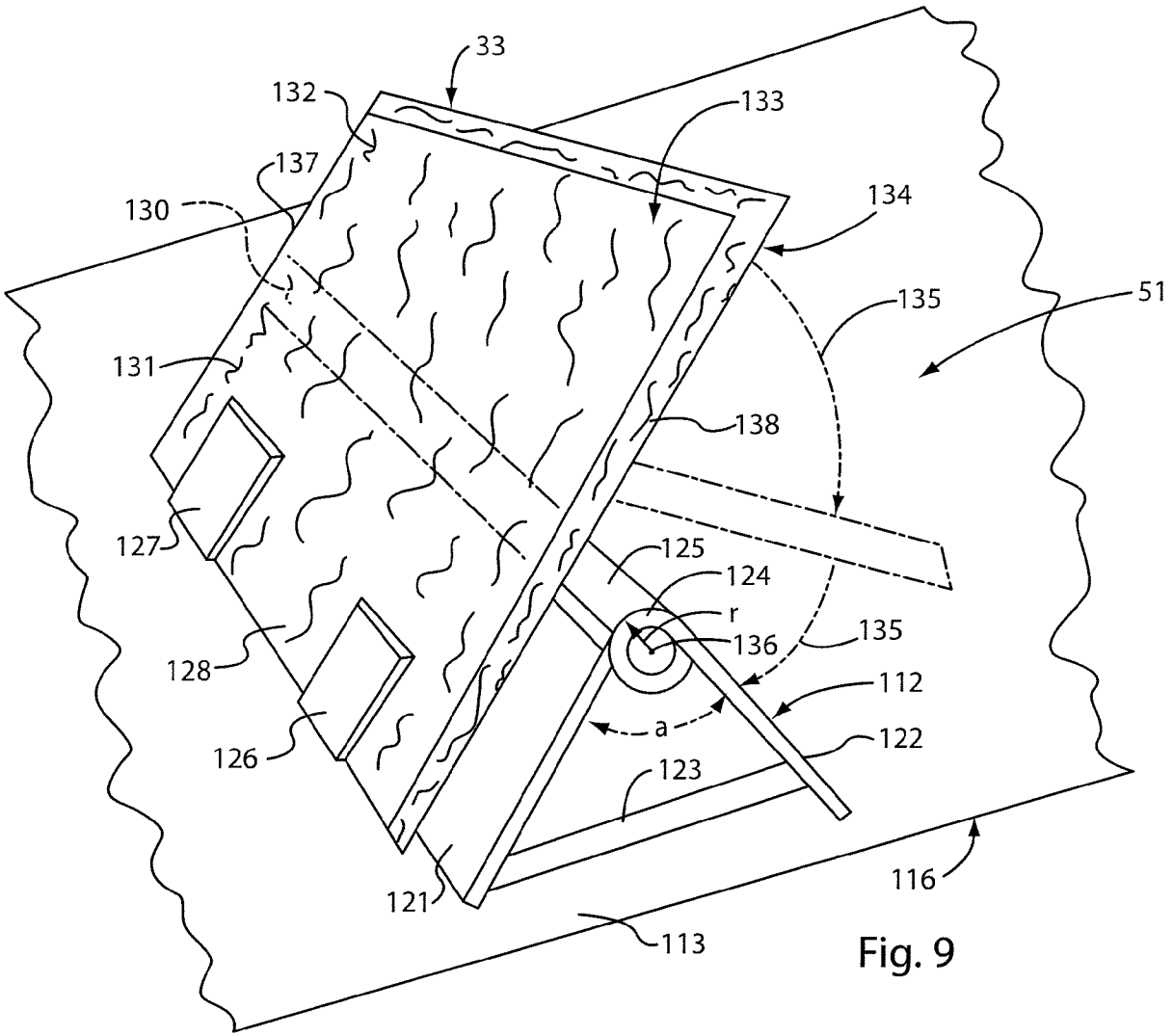

FIG. 9 is an enlarged fragmentary illustration of a rack, on a support such as a conveyor belt upper run, illustrating a shingle precursor disposed on and held on the rack, in full line illustration, and wherein there is also shown, in phantom, the manner in which a portion of the shingle precursor, when subjected to a sufficiently high temperature, will bend around the upper radius of the rack, under the force of gravity, to assume an inverted V-shaped configuration.

Figure 10:
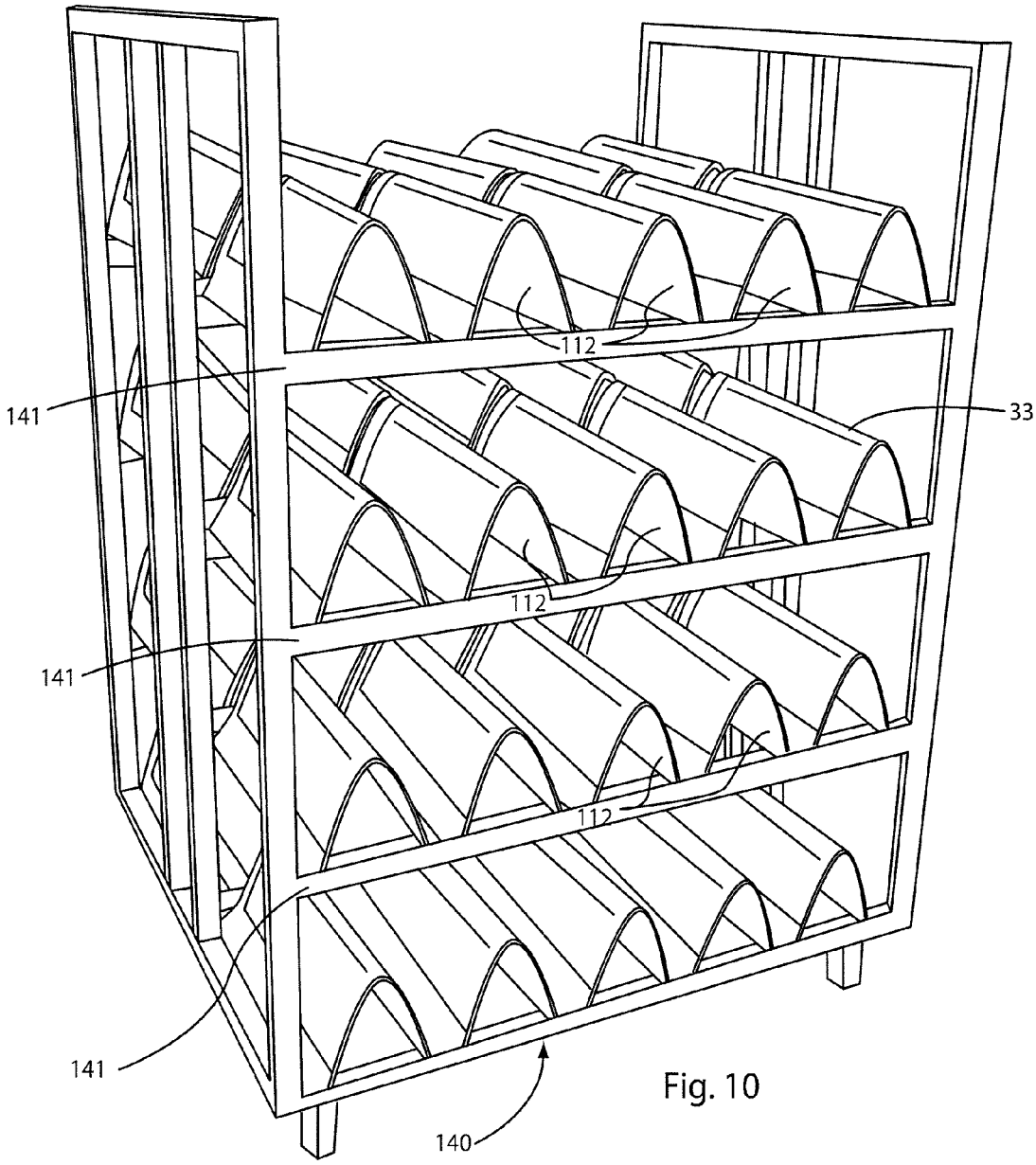

FIG. 10 is a perspective view of a composite rack assembly having a plurality of individual racks thereon, in multiple tiers, for receiving a plurality of individual racks onto which shingle precursors are applied, for delivery to a heated rack station and optionally, to a cooling zone.

Figure 11:
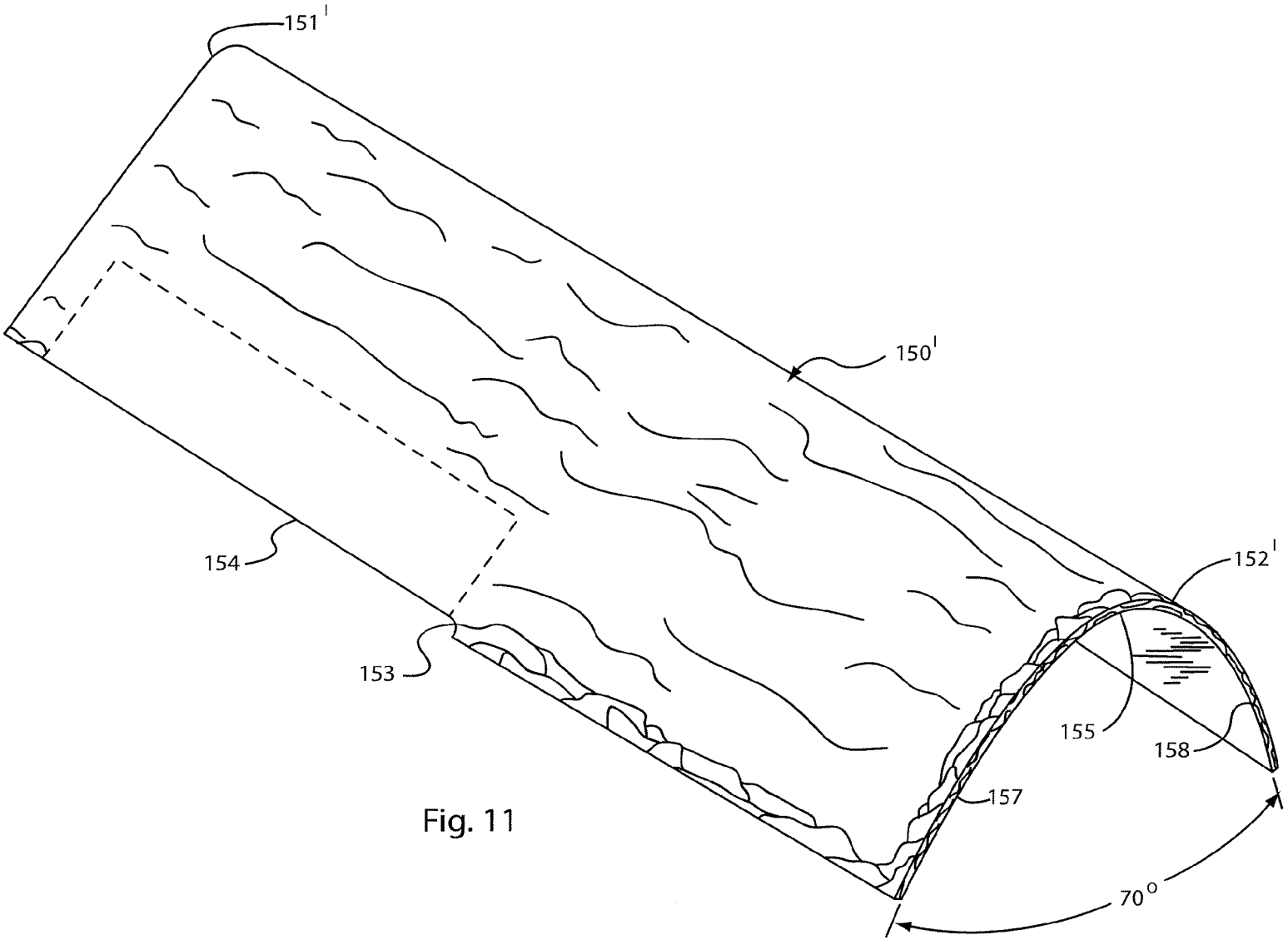

FIG. 11 is a perspective view of a hip, ridge or rake shingle in accordance with this invention, wherein the lower (right) end of the tab portion of the shingle, which is the visible portion of the shingle when the shingle is installed on a roof, has a larger internal radius than the opposite end of the shingle, with the opposite end of the shingle being in the headlap portion of the shingle.

Figure 12:
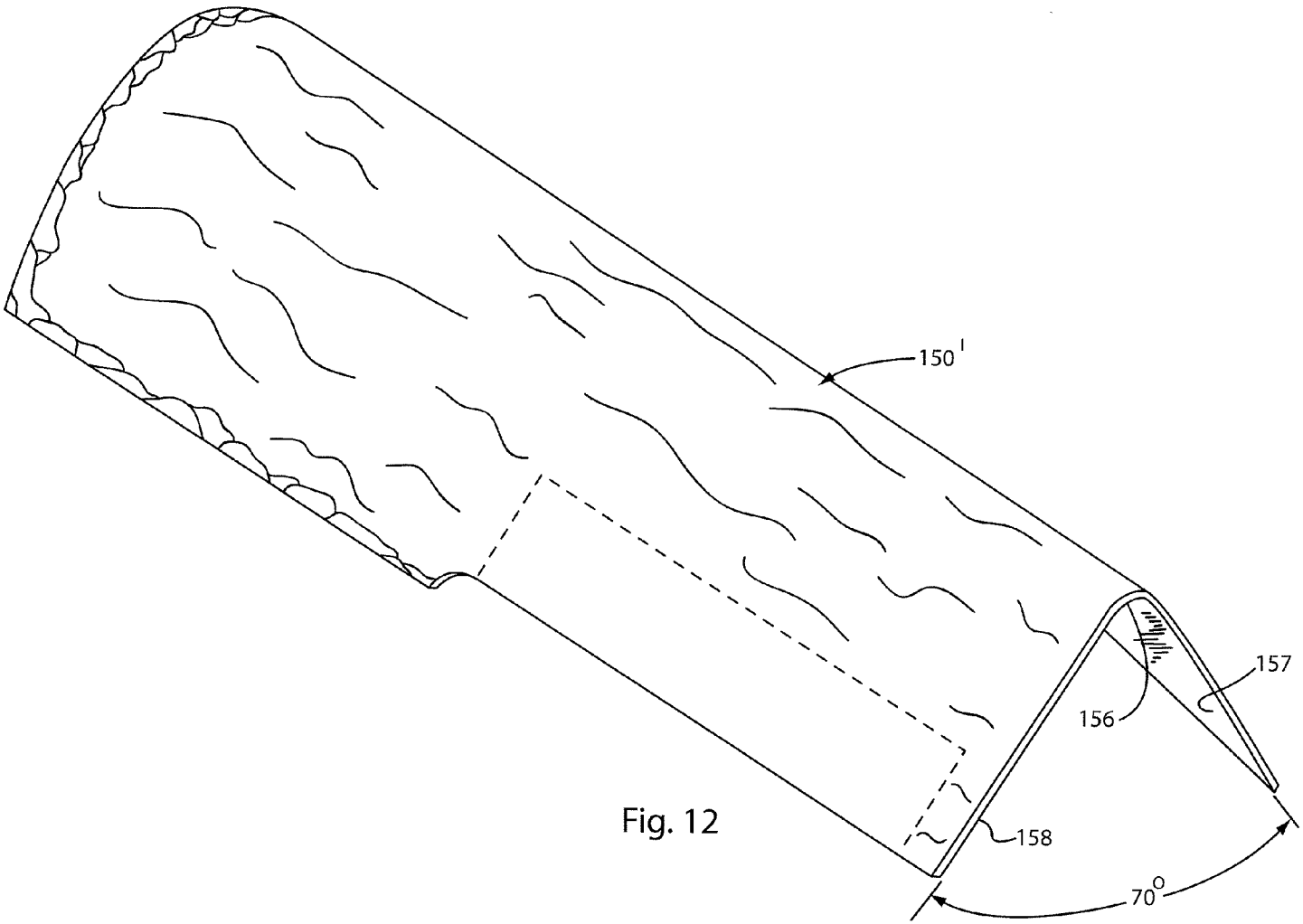

FIG. 12 is an illustration similar to that of FIG. 11, for the shingle of FIG. 11, taken from the opposite end, wherein the tighter radius at the headlap portion of the shingle is illustrated.

Figure 13:
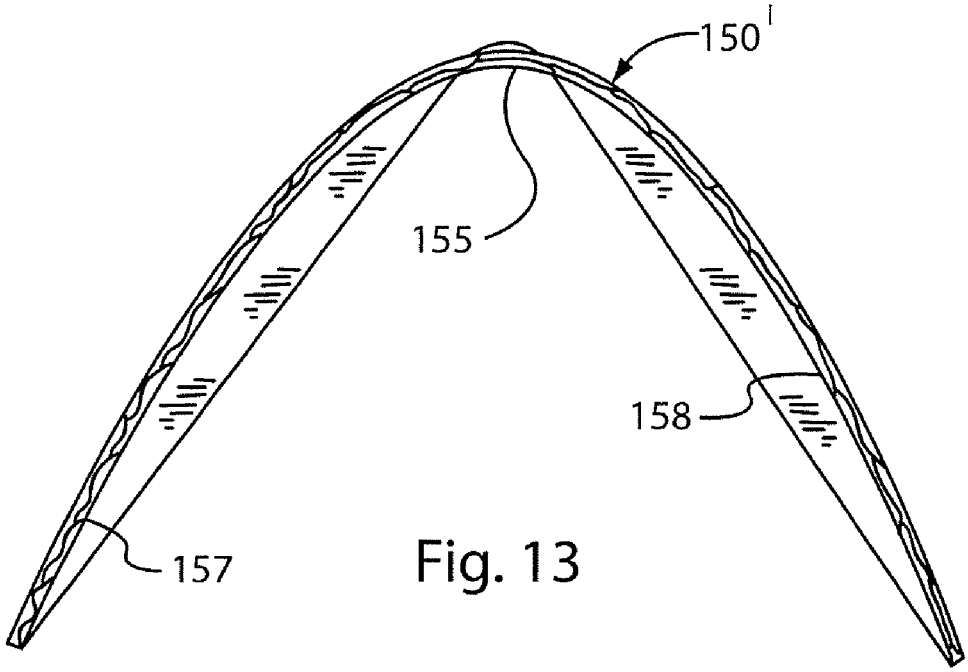

FIG. 13 is an elevational view of the end of the shingle of FIG. 11 taken from the right end of FIG. 11.

Figure 14:
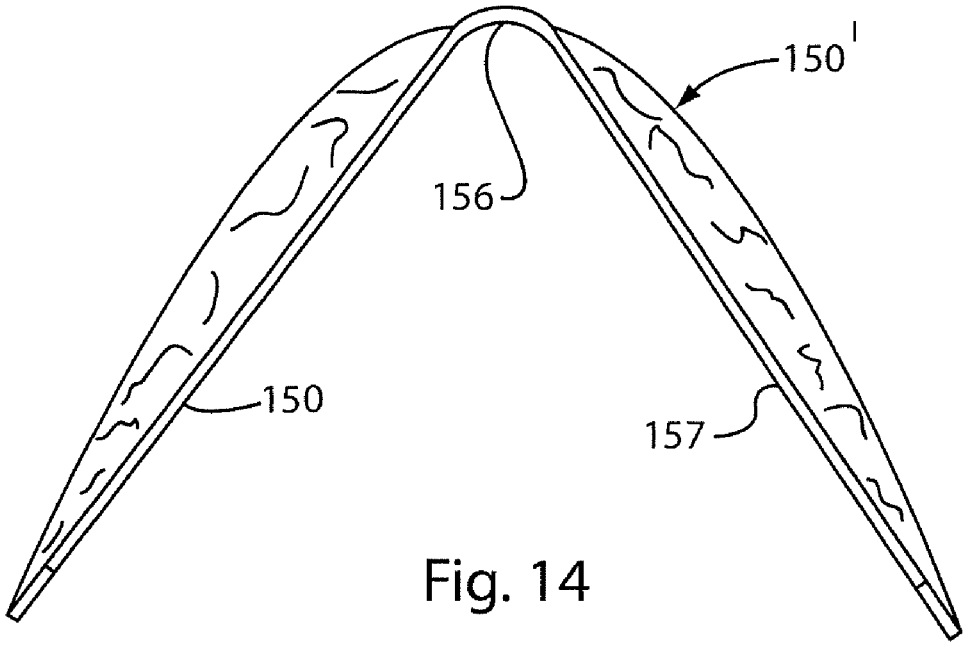

FIG. 14 is an elevational view of the shingle of FIG. 11 similar to that of FIG. 13, but wherein the illustration of FIG. 14 is taken from the right end of FIG. 12.

Figure 15:
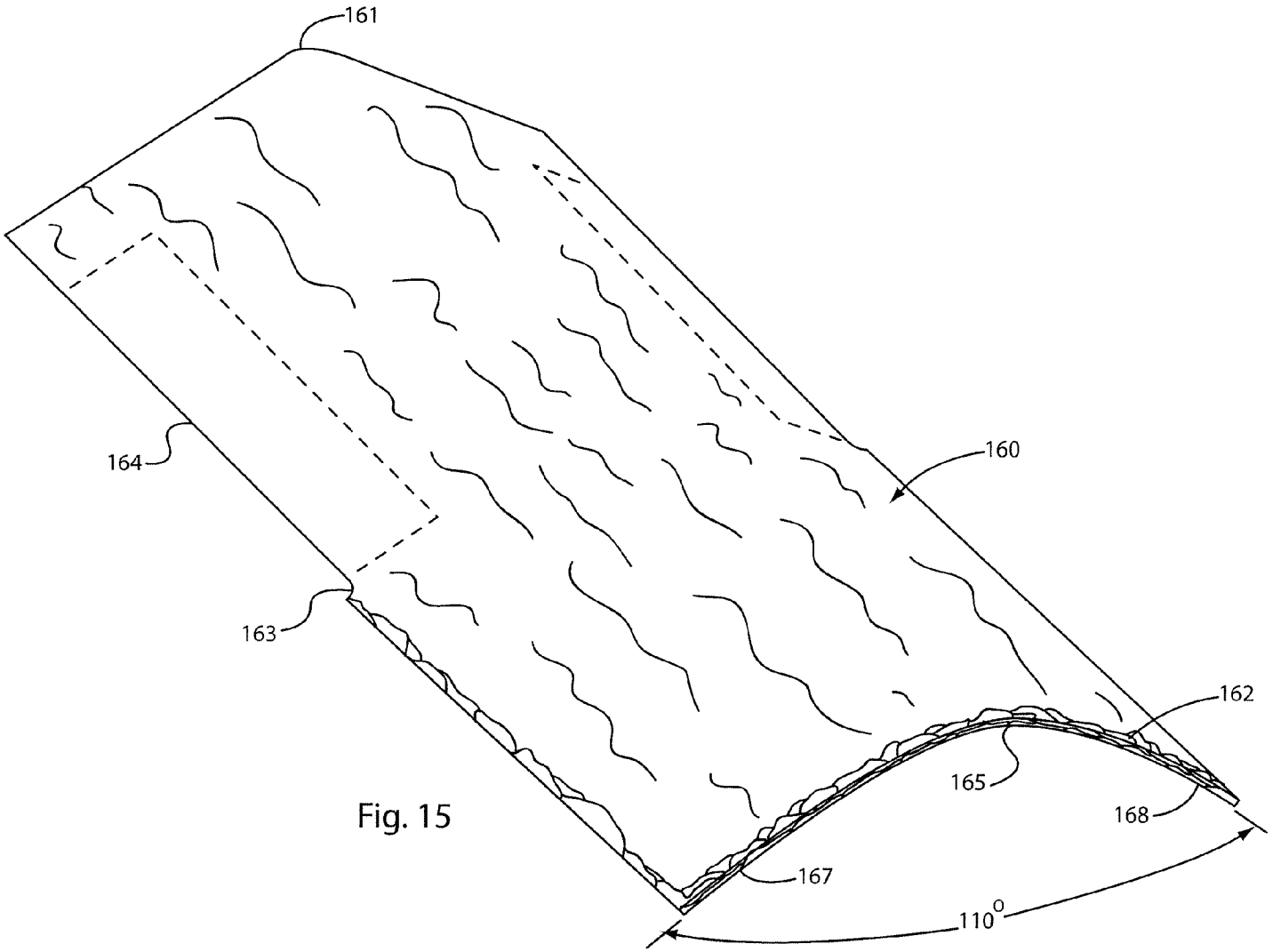

FIG. 15 is a perspective view of a shingle, similar to that of FIG. 11, but wherein the internal included angle of the legs of the shingle is greater than that of FIG. 11.

Figure 16:
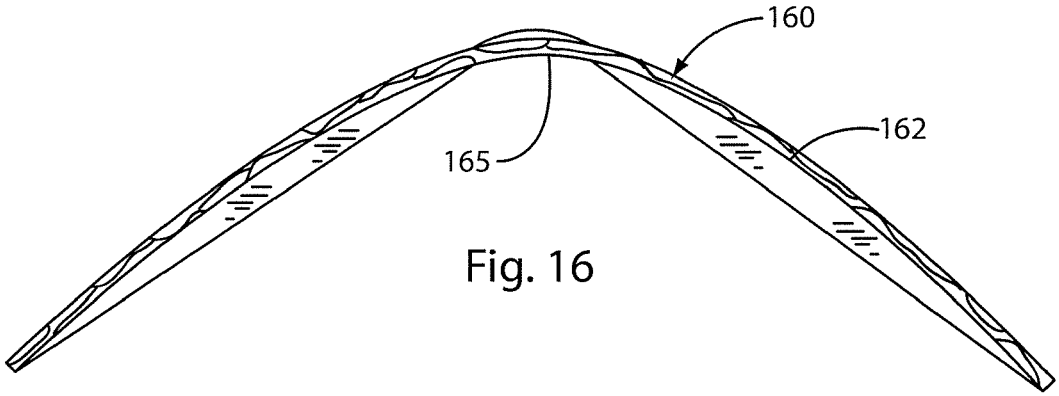

FIG. 16 is an elevational view of the right end of the tab portion of the shingle of FIG. 15, in end view.

Figure 17:
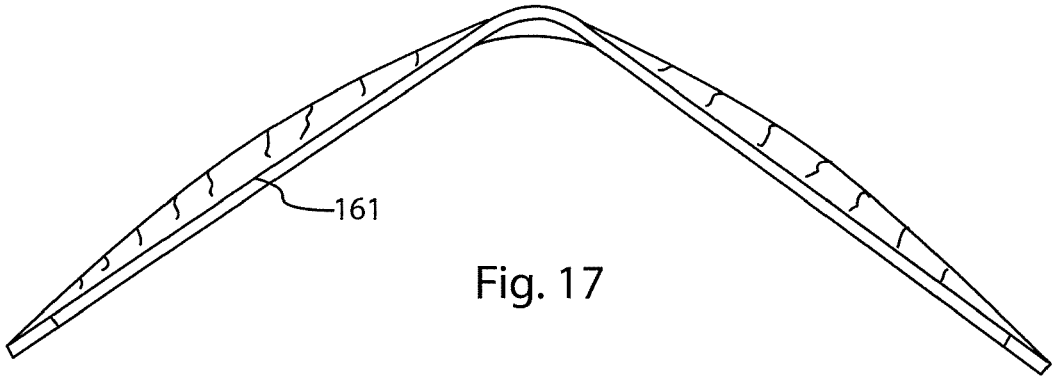

FIG. 17 is an elevational view of the shingle of FIG. 15, similar to that of FIG. 16, but taken from the opposite end of the shingle of FIG. 15, from that illustrated in FIG. 16.

Figure 18:
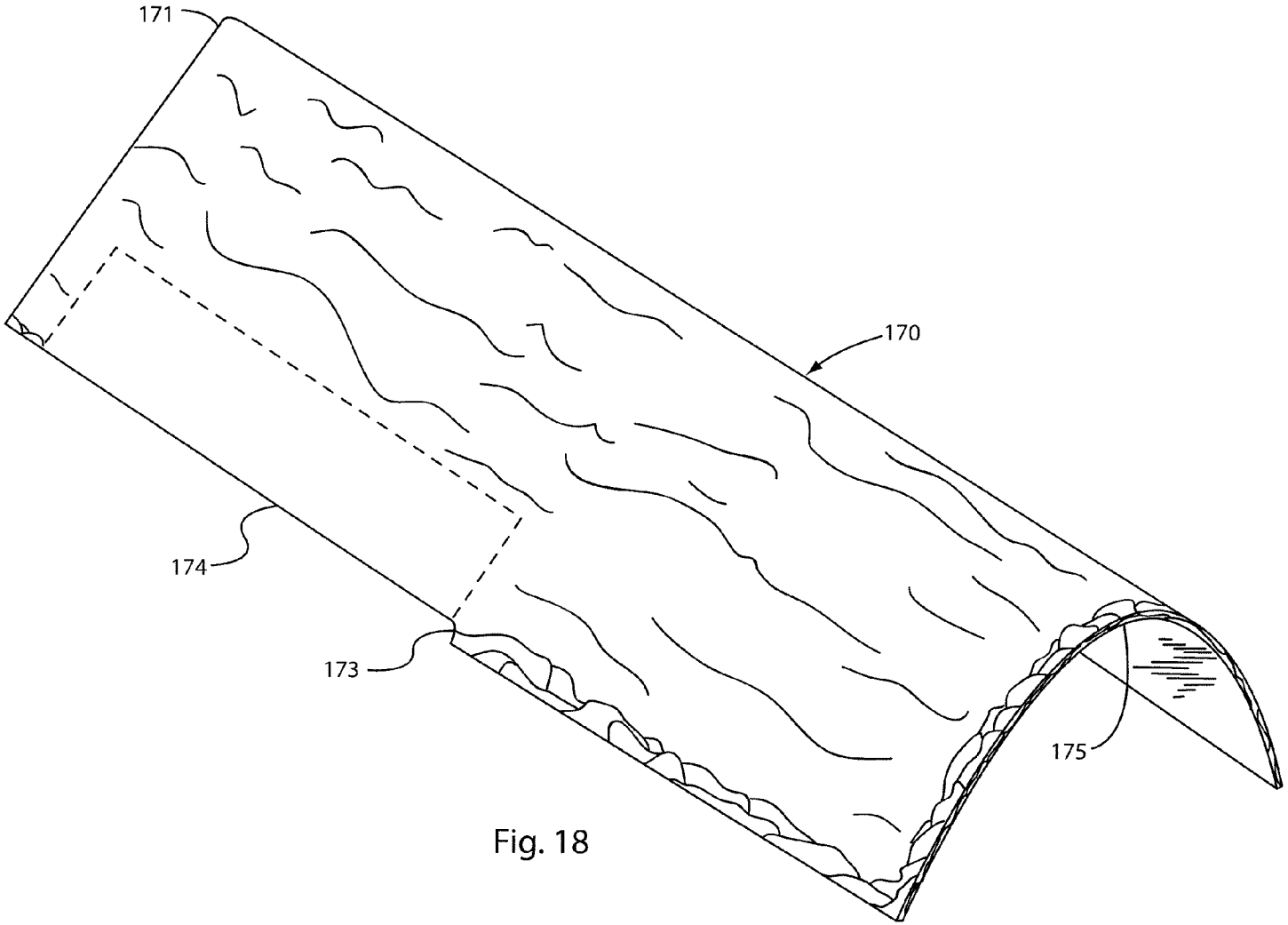

FIG. 18 is a perspective view of a shingle in accordance with this invention, similar to the illustration of FIG. 11, but wherein the internal radius of the inside of the shingle of FIG. 18, at the left end or headlap end thereof, is such a tight radius as to appear to be no radius at all.

Figure 19:
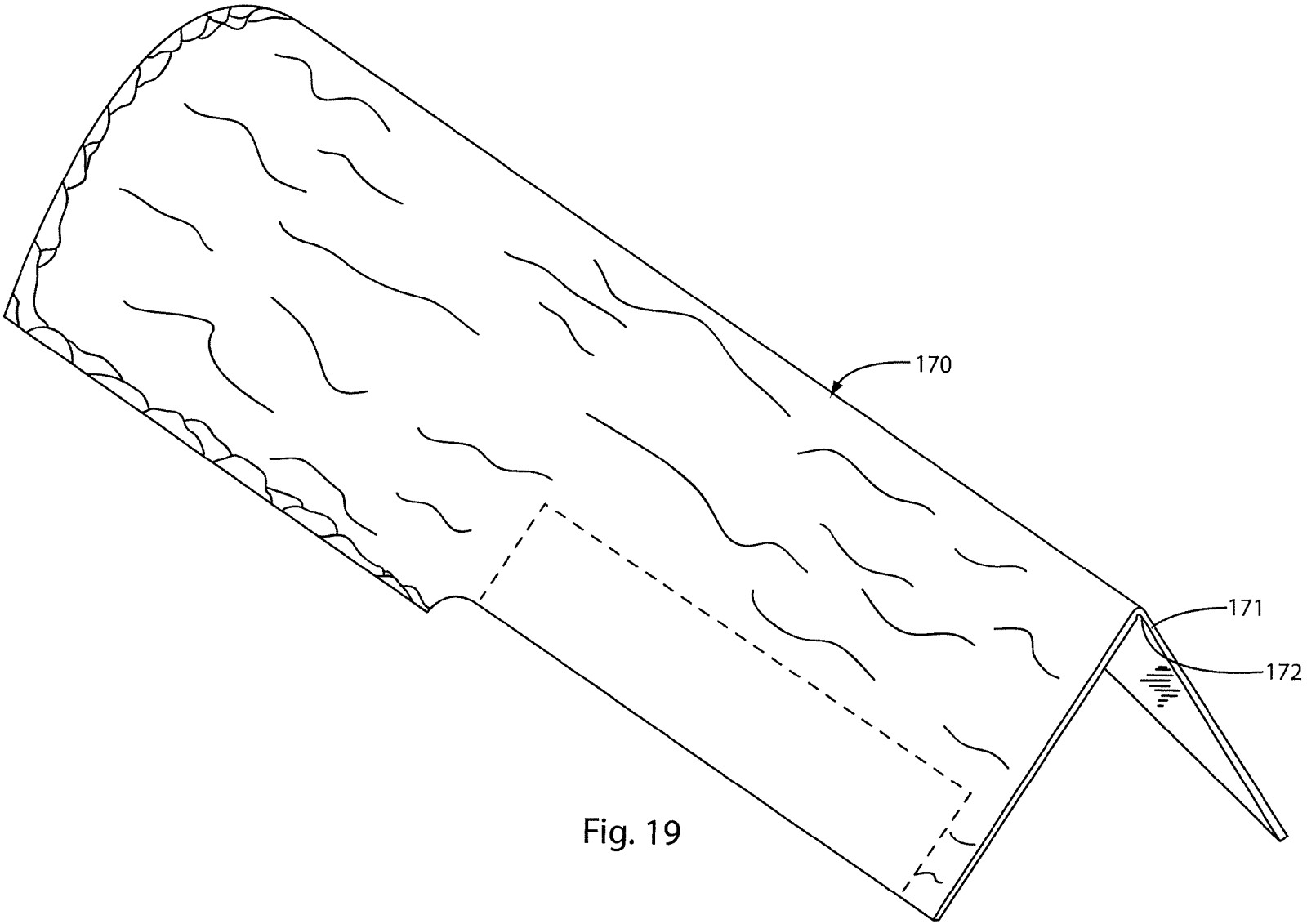

FIG. 19 is an illustration of the shingle of FIG. 18, in perspective view, but taken from the opposite end of the shingle of FIG. 18, illustrating the very tight internal radius at the upper end of the headlap portion thereof.

Figure 20:
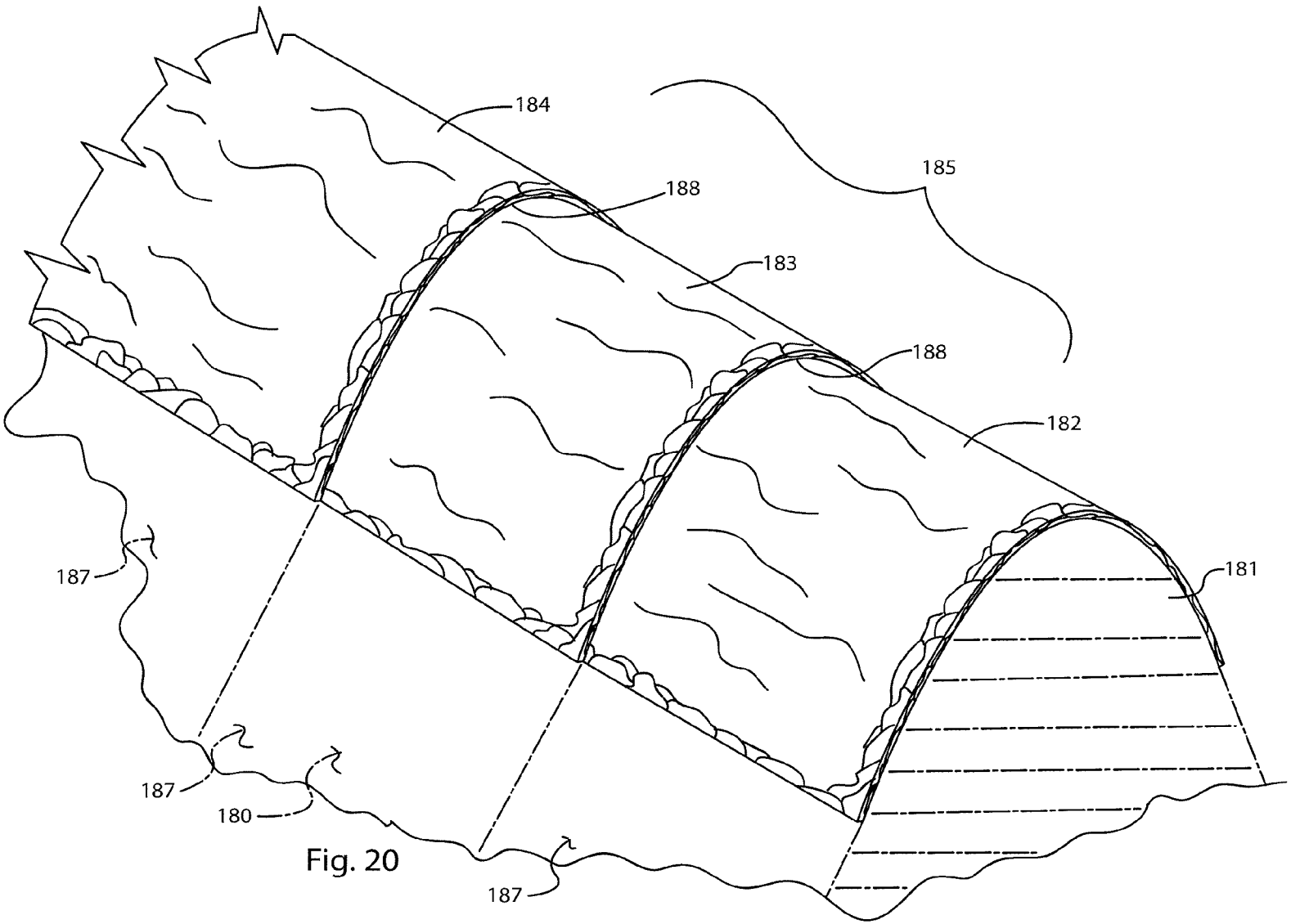

FIG. 20 is an illustration of a roof, in fragmentary, diagrammatic form, having an array of shingles of the type of this invention applied thereto over a ridge thereof.

DETAILED DESCRIPTIONS OF THE PREFERRED EMBODIMENTS

Figure 1:
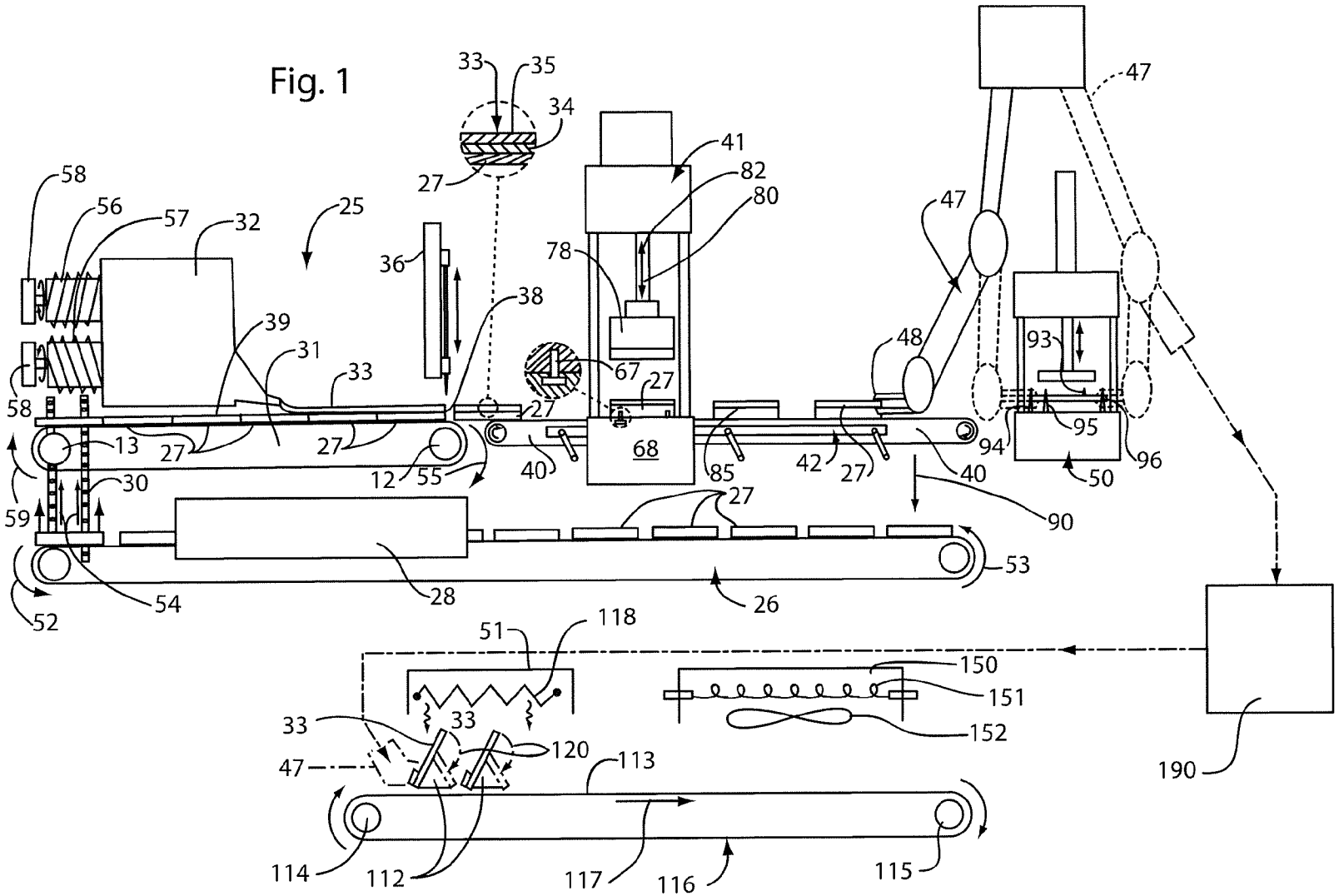
FIG. 1 is a schematic, side elevational view of an apparatus for practicing the method of this invention, wherein at the right end thereof is an enlarged schematic view of a heated rack station and subsequent cooling zone, for receiving a plurality of shingle precursors, in which the shingle precursors are loaded onto shingle racks for applying bends or curvature thereto.
Figure 3:
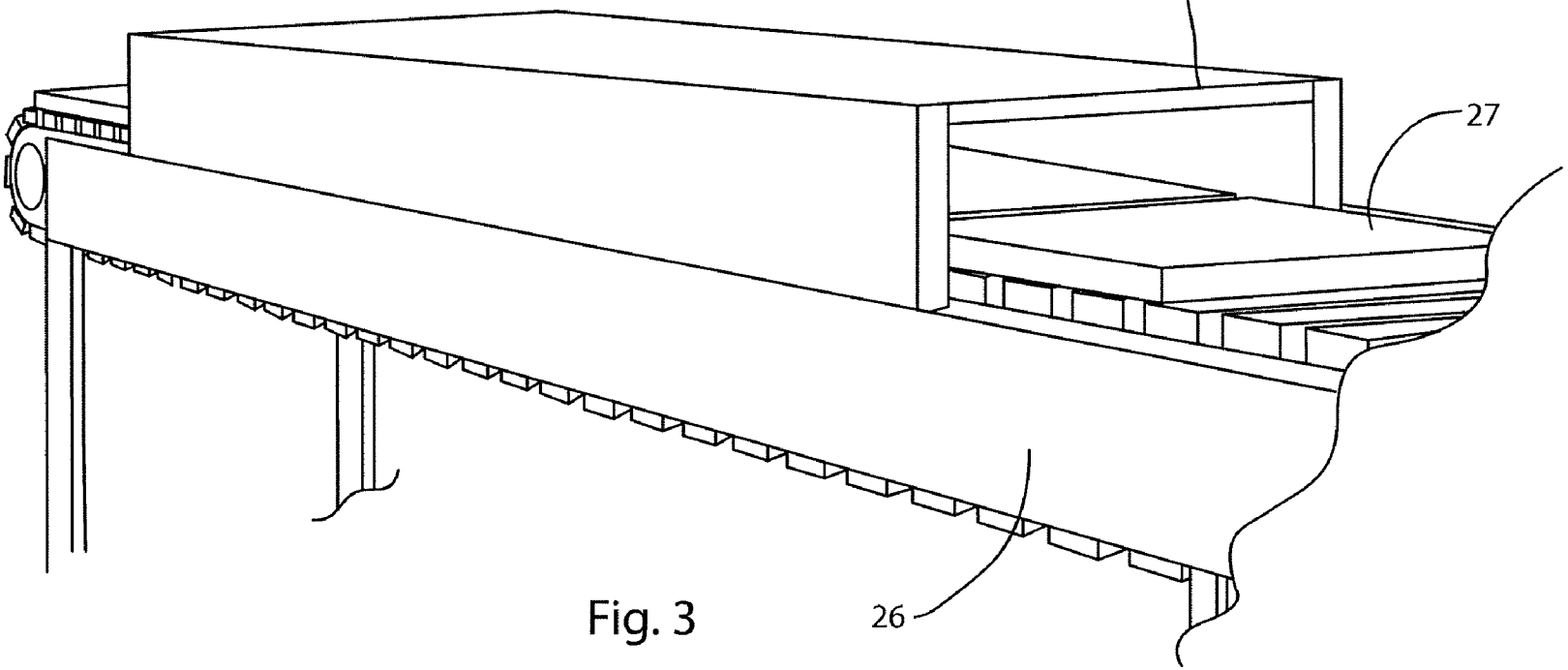
FIG. 3 is a side perspective view of the return conveyor and preheater of FIG. 2, with the right portion of the return conveyor being shown broken away.
Figure 4:
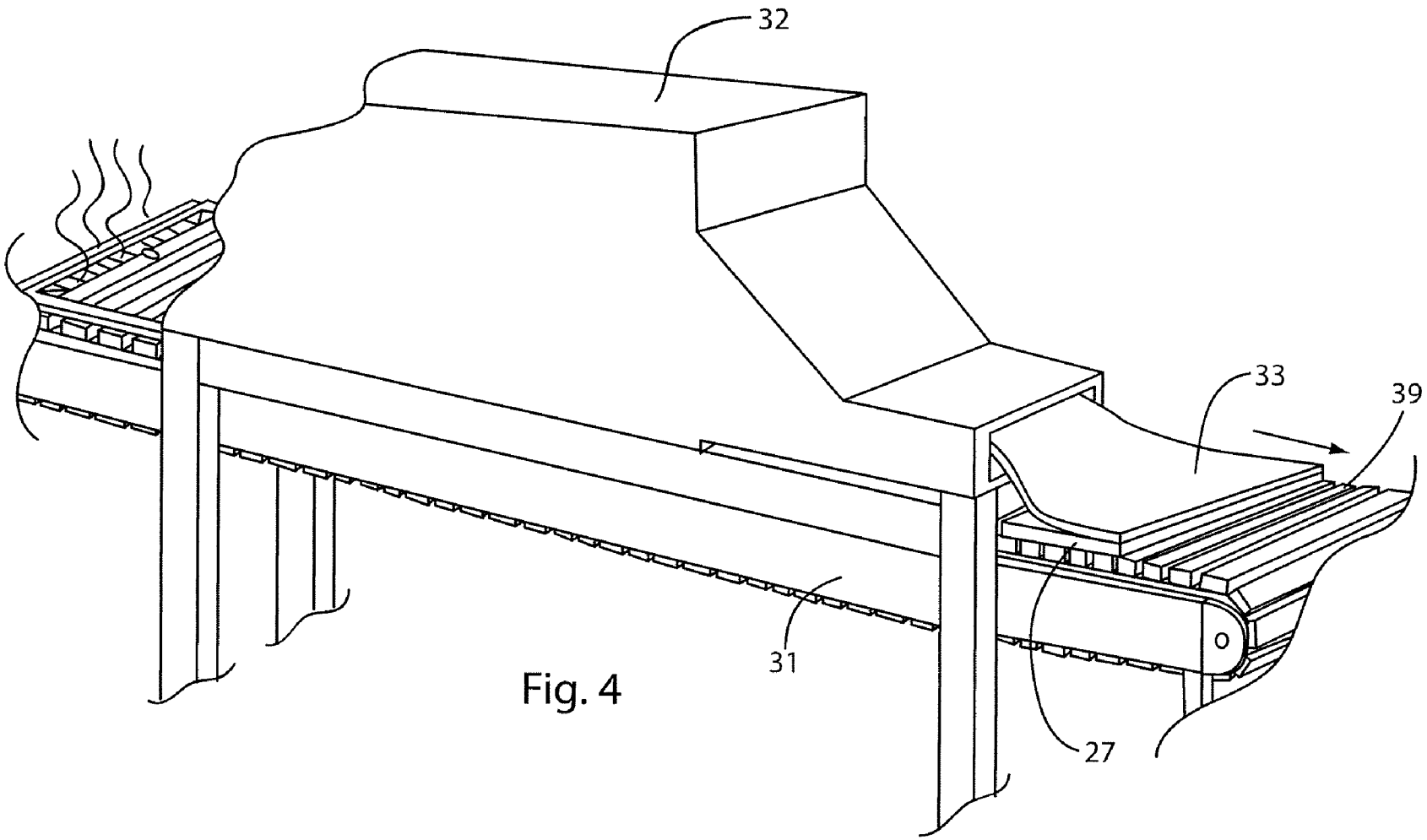
FIG. 4 is a side perspective view of the extruder for extruding shingle-forming material and applying the same onto carrier plates that are delivered along a conveyor, fragmentally illustrating a portion of the left end of FIG. 1.
Figure 5:
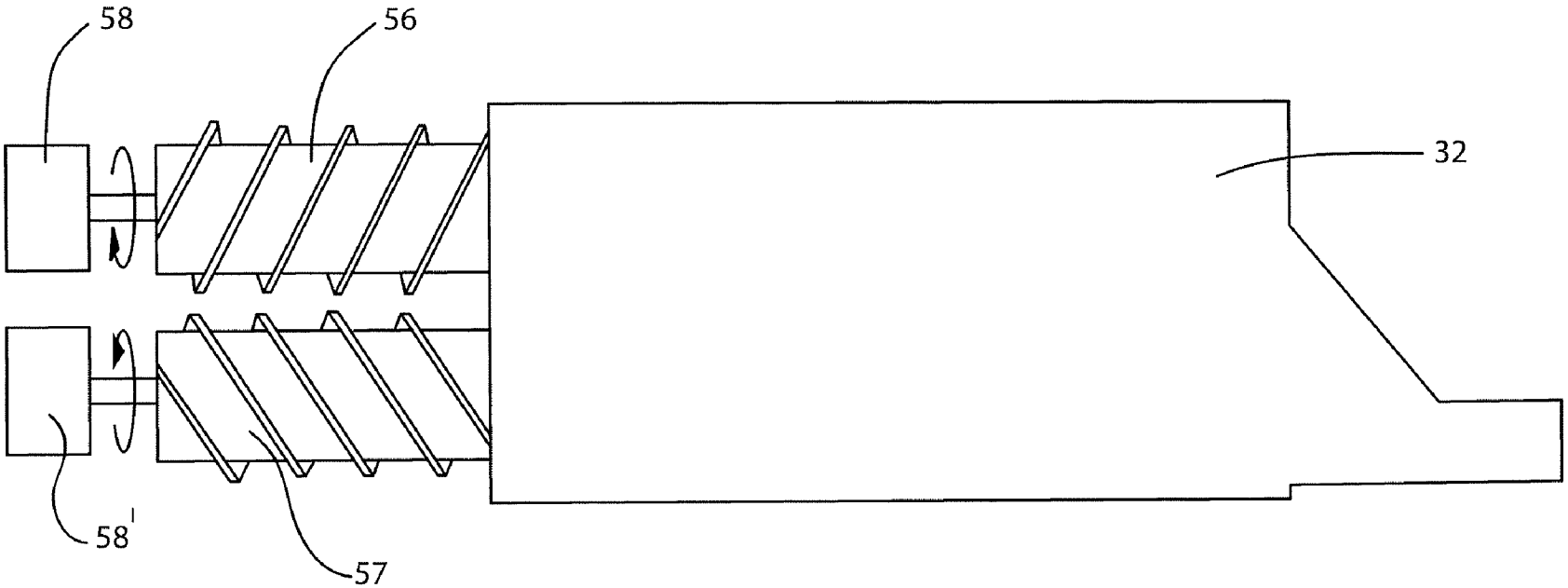
FIG. 5 is a schematic side elevational view of the two single screw extruders of FIGS. 1 and 4.

Referring now to the drawings in detail, reference is first made to FIG. 1, wherein the apparatus of this invention is generally designated by the numeral 25 as comprising a preliminary conveyor apparatus 26 for delivering carrier plates 27 through a carrier plate preheater apparatus 28, as shown in perspective view in FIG. 3, whereby the carrier plates are delivered via a transfer mechanism 30 to an extruder conveyor apparatus 31 between rotatable end shafts 12, 13, whereby the carrier plates are delivered beneath an extruder apparatus 32, shown in larger view in FIG. 5, of the type preferably having a pair of single screw extruders 56, 57, by which a co-extruded sheet of shingle material 33, preferably comprised of a core material 34 covered by a layer of capstock material 35 is co-extruded onto the carrier plates 27, as is shown more clearly in perspective view in FIG. 4, and the carrier plates are delivered end-to-end therebeneath, as shown in FIG. 1.

The carrier plates with the shingle material 33 thereon are then delivered past a severing mechanism 36, for severing the shingle material at an end 38 of a carrier plate.

The carrier plates 27 are then delivered to a speed-up conveyor 40, at which the carrier plates are serially separated one from the other, for serial delivery to a compression mold 41.

A walking beam type transport mechanism 42 lifts the carrier plates from the conveyor mechanism 40, into the compression mold 41 and subsequently out of the compression mold 41. The carrier plates 27 are then transferred downwardly, as shown by the arrow 90 from the conveyor 40, back to the return conveyor 26, for re-use.

It will be understood that the extruders 56, 57 could feed multiple compression molds 41, such as anywhere from two to four compression molds, in some desired sequence, via a plurality of speed-up conveyors 40, if desired, or in any other manner, and in some operations such could be a preferred embodiment.

A transfer mechanism 47, which may be of the robot type, is provided for lifting a molded shingle precursor 48 from its carrier plate 27, and delivering the shingle precursor 48 to a severing station 50 for removing flashing therefrom. At the severing station 50, the shingle precursor 48 is placed onto a secondary plate where blades will trim flashing from the various edges thereof, as will be described more fully hereinafter.

The robotic or other type of mechanism 47 will then remove the shingle precursor from the flash trimming station 50 and deliver it to a rack station 51 as will also be described in detail hereinafter, and wherein the shingle precursor is heated to a predetermined temperature, and provided with a bend or curvature resulting from the applied heat while it is on the rack.

At the left lower end of FIG. 1, it will be seen that a representative mechanism 30 illustrates the manner in which carrier plates 27 can be delivered from the upper run of the conveyor mechanism 26, which conveyor mechanism is moving in the direction of the arrows 52, 53, to lift the carrier plates 27 upwardly in the direction of the arrows 54, to place the same onto the upper run 39 of the conveyor 31, which conveyor 31 is being driven to move its upper run in the direction of the arrows 55, 59.

With the carrier plates 27 being moved rightwardly with the upper run of the conveyor 31 as shown in FIG. 1, to pass beneath the co-extruder 32, it will be seen that a pair of single screw extruders, 56, 57, being motor driven by motors 58, 58', produce a multi-layer extrudate comprising a core layer 34 and a capstock layer 35 of soft, semi-molten shingle material 33 onto a series of carrier plates 27 that are passing beneath the extruder 32, end-to-end, as shown in FIGS. 1 and 4, for example.

Figure 2:
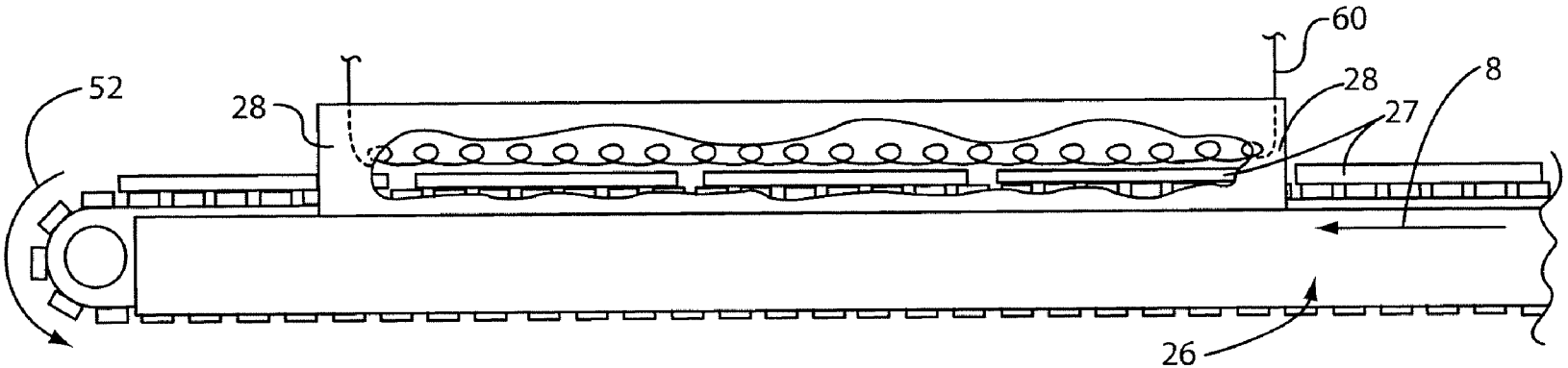
FIG. 2 is a schematic side elevational view of a preheater for preheating carrier plates being delivered along a conveyor, for return to an extruder at the left end of FIG. 1, for receiving extruded shingles thereon, with a portion of the preheater being broken away to illustrate a heating element therein.

With reference to FIG. 2, it will be seen that the preheater 28 can be provided with any suitable means 60 for preheating the carrier plates 27 as they pass therethrough. The heating means 60 can be electric heating means, a heated fluid passing through a pipe or tube, an infrared heater, a microwave heater, or of any other suitable means, such as a hot air blower, or combination of means if desired.

Figure 2A:
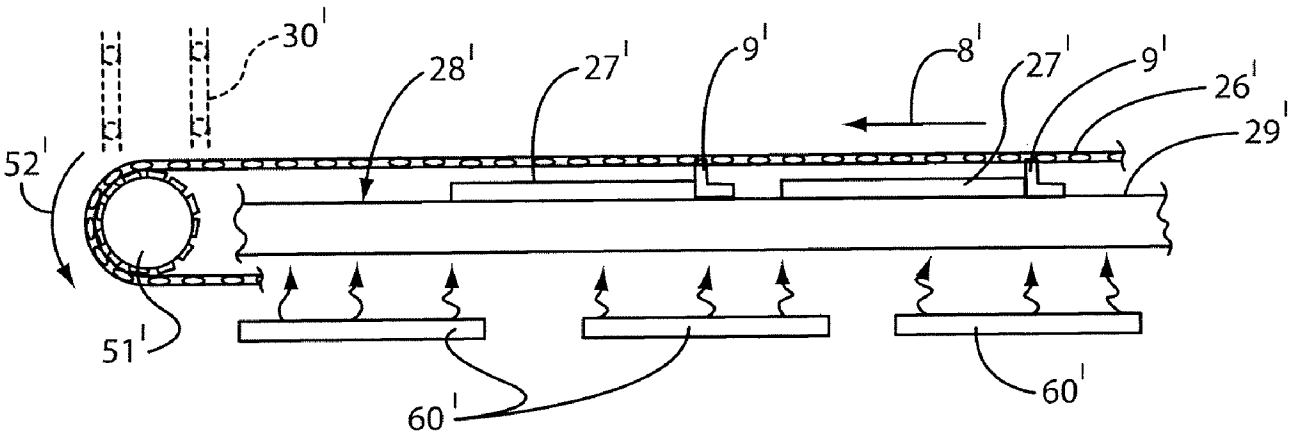
FIG. 2A is a view somewhat similar to that of FIG. 2, but of an alternative embodiment of a preheater.

In FIG. 2A an alternative embodiment of a preheater 28' is provided, wherein carrier plates 27' are delivered leftward along a preferably steel plate 29' (fragmentally shown) with heating elements 60' disposed therebeneath for heating the plate 29' for transferring heat to the carrier plates 27'. The carrier plates are moved along the plate 29' by movable brackets 9' of angle iron or other types, in the direction of arrow 8', which are driven from the opposite side of the preheater 28' to that shown in FIG. 2A by a conveyor chain 26' (fragmentally shown), in turn driven by sprockets 51' at ends thereof, turning in the direction of the arrow 52'. A transfer mechanism 30' (shown in phantom), like the transfer mechanism 30 of FIG. 2, lifts the carrier plates 27' upwardly at the left end of the preheater 28' to pass beneath the extruder 32. The heating elements 60' can be any of the heating means described above for the embodiment of FIG. 2. Supplemental heating elements (not shown) can also be used, and they can be infrared elements, quartz lamps or any other means for heating the plate 29' or the carrier plates 27'.

With reference to FIGS. 2B and 2C, it will be seen that the carrier plates 27 will each have an upper surface 61, preferably, with a plurality of grooves 63, 64, etc. and preferably fastening zones 65, molded therein, configured to be the reciprocal of the configuration of the underside of shingles to be formed thereon, such that the undersides of the shingles will have their shingle material entering the grooves 63-64 and fastening zones 65, to provide suitable spacing ribs and fastening zones (not shown) for the undersides of shingles to be formed on the carrier plates 27, with the ribs serving to support shingles mounted on roofs. Alternatively, the carrier plates could be solid, if desired. Also, alternatively, other features may be provided on the upper surfaces of carrier plates 27 to impart reciprocal features to the shingles molded thereby.

With specific reference to FIG. 2C, it will be seen that the carrier plates 27 may have locating pin holes 66, to facilitate the proper placement of the carrier plates 27 over pins 67 as shown in FIG. 1 in the bottom 68 of the compression mold 41, when the carrier plates are delivered to the compression mold 41, for proper and precise location of the carrier plates 27 in the compression mold 41. It will be seen that in FIGS. 2B and 2C, on the upper surface 59 of the carrier plate 27, there is a hump 62 extending longitudinally thereof, in the center of the plate 27. This is so that, when a shingle precursor is molded against the plate 27, the hump 62 will create a thinner zone in the shingle precursor in the bottom thereof, so that when heat is applied to the shingle precursor when it is disposed on a rack, as will be addressed hereinafter, the zone 130 of the shingle precursor 33, as is explained hereafter with reference to FIG. 9, will be thinner than the zones 131 and 132 of the shingle precursor, so that, as the shingle precursor 33 becomes softer, the upwardly extending zone 132, can, by means of gravity, bend at the shingle precursor zone 130, so that the zone 132 of the shingle precursor drops against the surface 122 of the rack 112.

Figure 6:
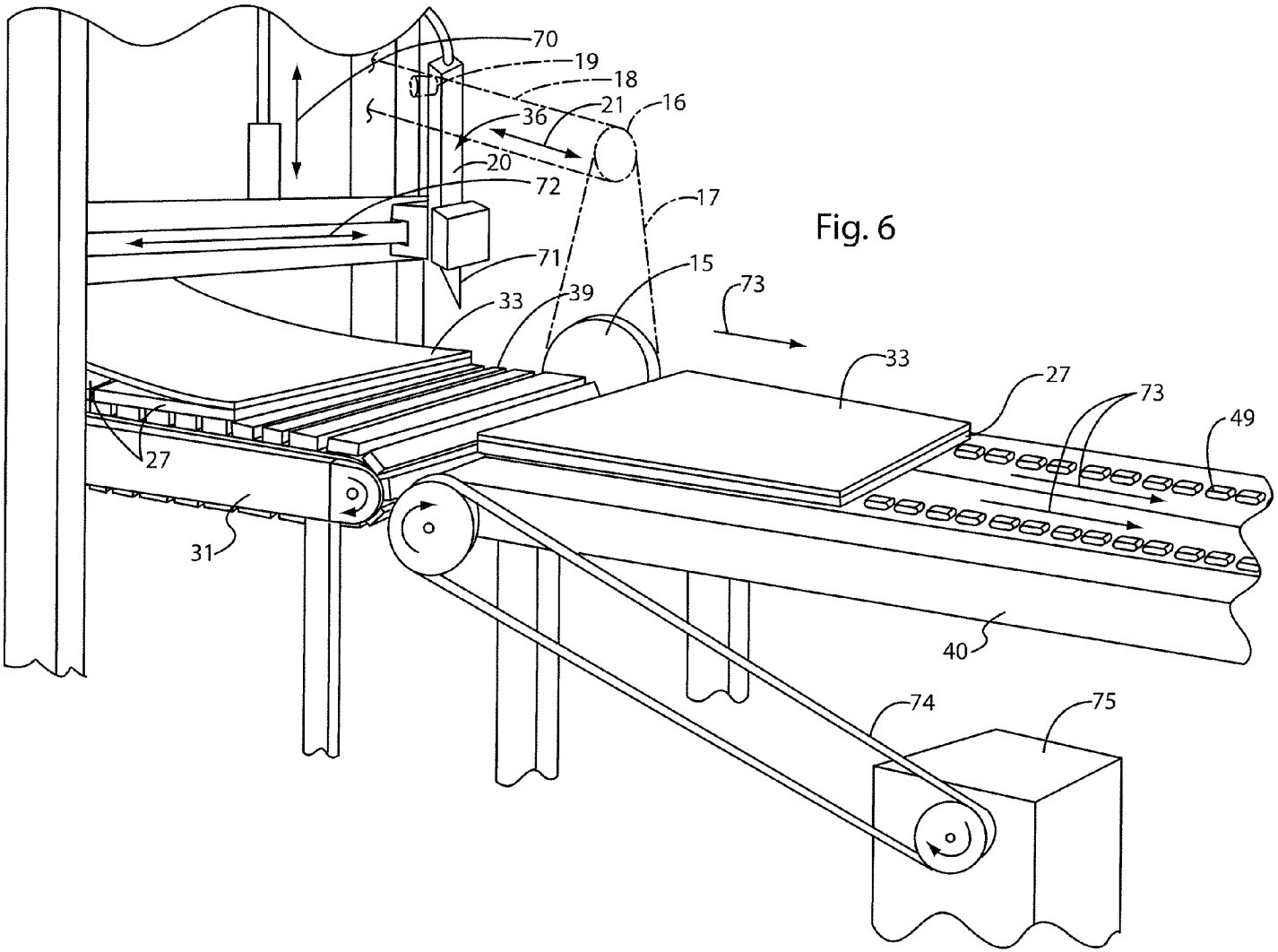
FIG. 6 is an enlarged fragmentary schematic illustration of the mechanism for severing shingle material being extruded onto carrier plates, and a means for thereafter separating the individual carrier plates with shingle material thereon, from each other.

With reference now to FIGS. 1 and 6, the placement of the extrudate 33 onto a serially arranged and touching number of carrier plates 27 is illustrated at the outlet of the extruder, as is the severing mechanism 36 by which the shingle material 33 is serially severed at each endwise location of a carrier plate.

The severing mechanism 36 operates such that it can be lowered or raised as indicated by the direction of the double headed arrow 70 shown in FIG. 6, with a severing blade 71 thereof being moved transversely of the upper run 39 of the conveyor 31, in the direction of the double headed arrow 72, to traverse the conveyor upper run 39, to sever the shingle material 33 as shown in FIG. 6, to overly each carrier plate 27.

The severing mechanism 36 may optionally be longitudinally moveable in correspondence with the longitudinal movement of the carrier plates, as shown in phantom in FIG. 6, via a pulley or the like 15, rotating in unison with shaft 12, and in turn, driving a belt or chain 17 that in turn, is driving a shaft 16 that drives a longitudinal conveyor 18 connected at 19 to a post 20 of the severing mechanism 36, so that the mechanism 36 is longitudinally movable in the direction of the double headed arrow 21. This enables tracking of the severing mechanism 36 with the progress of the carrier plates 27 along the conveyor system, so that the precision of the cut is maintained.

Following the severing by the mechanism 36, the conveyor 40 is driven such that its upper run 49 moves in the direction of the arrow 73, at a faster rate than the upper run 39 of the conveyor mechanism 31, such that the carrier plates 27 become separated from each other.

The conveyor upper run 49 may be driven in any suitable manner, such as being belt driven as at 74 from a motor 75, or in any other manner, as may be desired.

Optionally, a plurality of extruder apparatus 32 and severing mechanisms 36 may, if desired, be used to supply extruded shingle material 33, disposed on carrier plates 27, to any selected ones of a plurality of compression molds 41, as may be desired.

Figure 7:
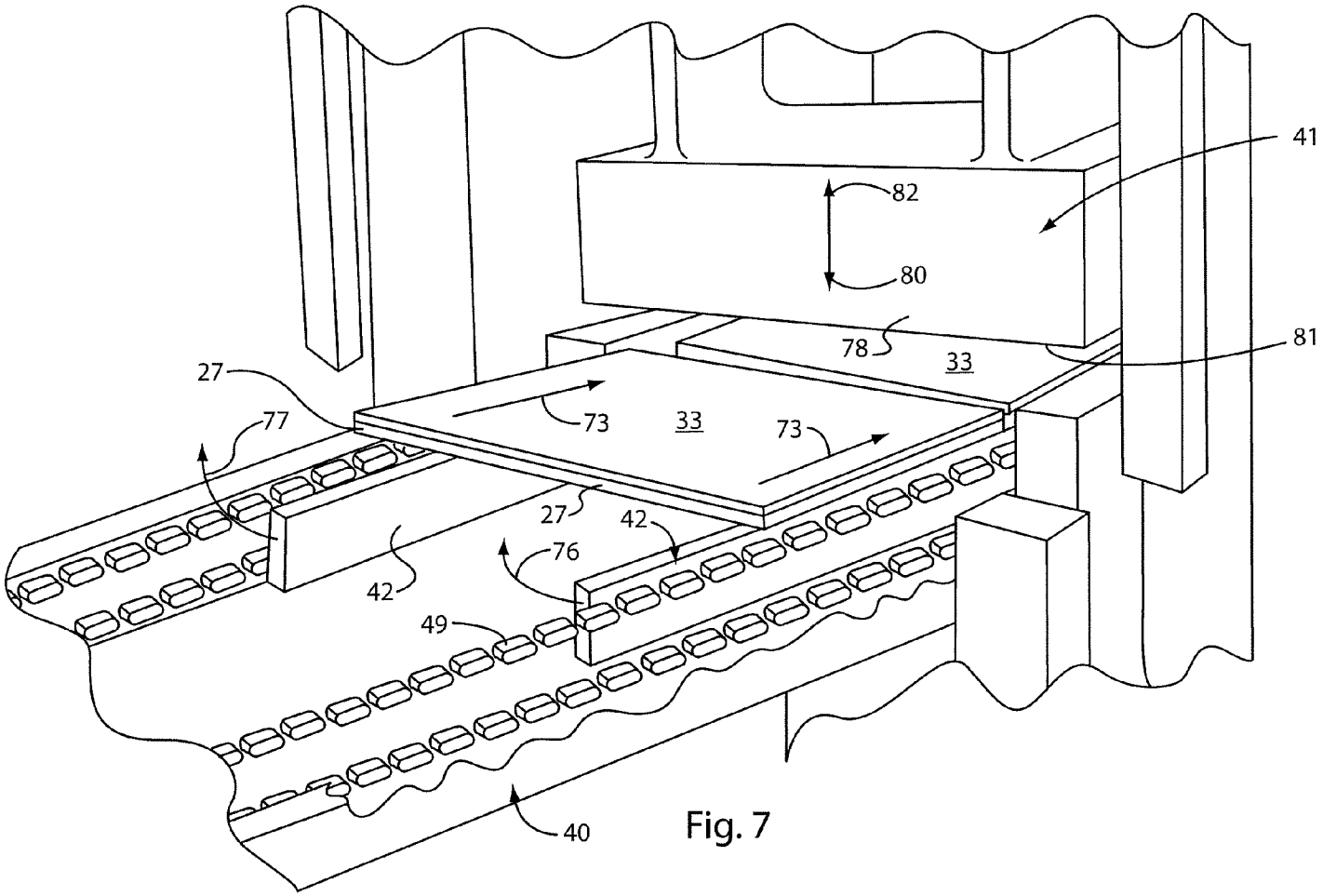
FIG. 7 is an enlarged fragmentary schematic illustration of a mechanism of the walking beam type, for receiving carrier plates with shingle material thereon and delivering them to a compression mold.

With reference now to FIGS. 1 and 7, it will be seen that the carrier plates 27 with their shingle material 33 applied thereto are delivered along the upper run 49 of the conveyor mechanism 40, to the walking beam transport mechanism 42, which is operated to be lifted upwardly as shown by the arrows 76, 77 in FIG. 7, to lift the carrier plates 27 into the compression mold 41, to place the carrier plates 27 onto a base mold portion 68 thereof, by which the pin recesses 66 (FIG. 2C) may be engaged by upstanding pins 67 in order to properly secure the location of the carrier plates and the shingle material 33 thereon in the compression mold 41. Thereafter, the upper die portion 78 of the compression mold 41 is moved vertically downwardly in the direction of the arrow 80, such that its lower surface 81, being configured to have a reciprocal surface configuration to that which is desired for the upper surface of the shingle that is to be molded on the carrier plate 27, engages the shingle material 33 under a predetermined pressure to force the shingle material 33 to conform to the reciprocal of the surface configuration 81 of the die 78, and thereafter, the die 78 is moved upwardly in the direction of the arrow 82 of FIG. 7 such that the then molded shingle precursor is ready for discharge from the compression mold 41. The use of the carrier plates enables supporting the shingle material for a shorter time in the compression mold than if the shingle material had to be released from the mold when it is more solidified and therefore more self-supporting.

Figure 8:
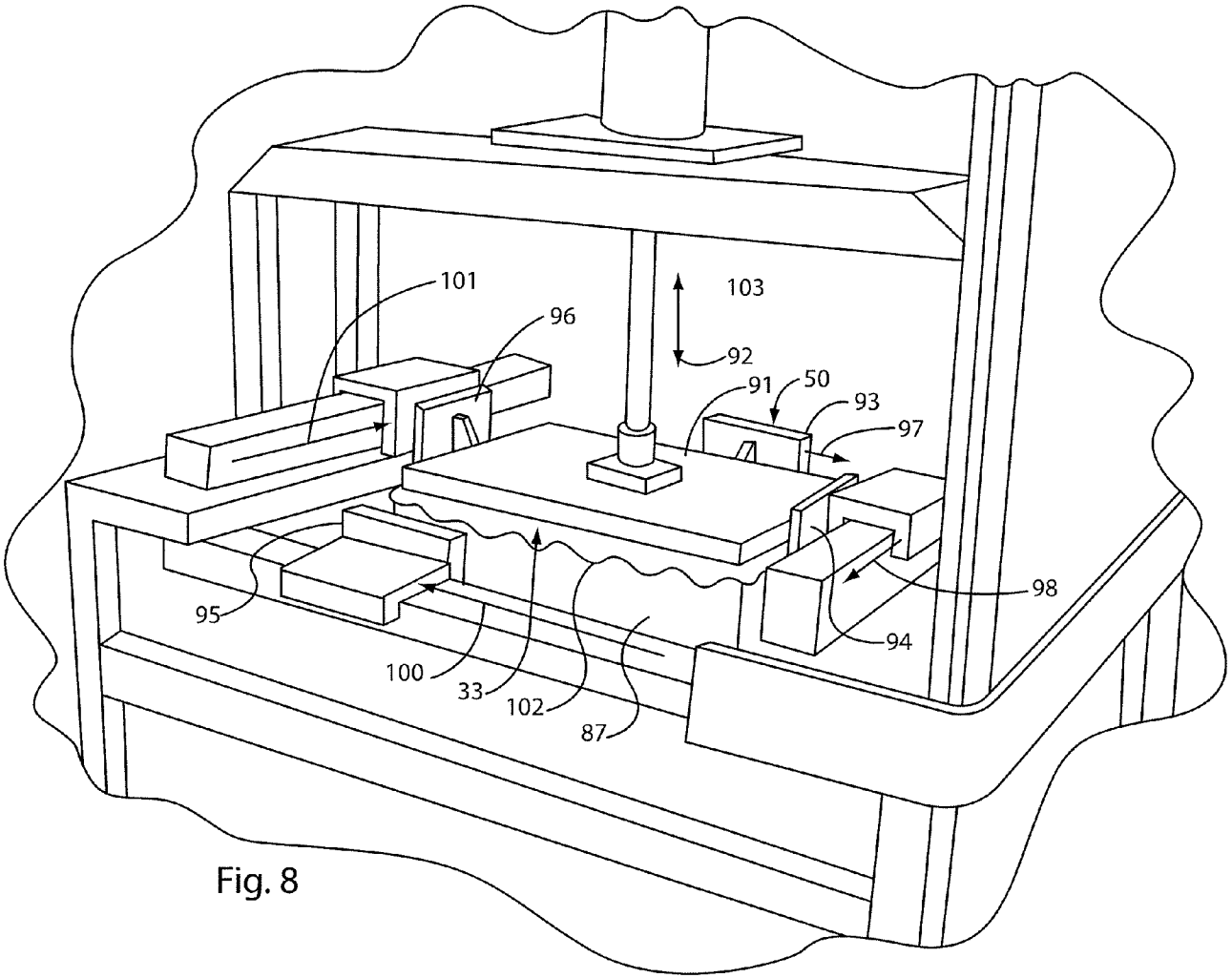
FIG. 8 is an enlarged fragmentary schematic illustration of the cutting mechanism for simultaneously cutting flashing from the molded shingle precursors that are situated on secondary plates in the cutting mechanism.

A lifting motion of the walking beam mechanism 42 then lifts the carrier plate 27 and the shingle precursor 33 molded thereon from the compression mold 41 and sequentially delivers the same to a flash trimming mechanism 50, as shown in FIGS. 1 and 8.

The robot or other mechanism 47 or an operator (manually) picks up a thus-formed shingle precursor off of its carrier plate 27, and delivers the same as shown by the full line and phantom positions for the robot mechanism 47 illustrated in FIG. 1, onto a plate 87 (FIG. 8) of the flash-trimming mechanism 50.

With reference to FIGS. 1 and 8, the flash-trimming mechanism 50 is more clearly illustrated.

Upon separation of a thus-formed shingle 33 from its carrier plate 27, the carrier plate becomes disengaged from the conveyor mechanism 40, and drops down as shown by the arrow 90 in FIG. 1, to the upper run of the conveyor mechanism 26, for re-use.

Upon placement of the shingle on the secondary plate 87 in the flash-trimming mechanism 50, an upper plate 91 is brought vertically downwardly in the direction of the arrow 92, to engage the upper surface of the thus-formed shingle 33, such that four severing blades 93, 94, 95, 96, may simultaneously be moved along the edges of the secondary plate 87, in the directions of the arrows 97, 98, 100 and 101, respectively, to sever flashing 102 therefrom, after which the plate 91 is lifted upwardly in the direction of arrow 103, and the robot arm 47 or a different mechanism (not shown) or an operator (manually) engages the thus trimmed shingle 33 and removes it from the flash trimming station 50.

Alternatively, the severing blades 93-96 could be driven to flash-trim in directions opposite to directions 97, 98, 100 and 101, or both in the directions 97, 98, 100 and 101 and in directions opposite thereto, in back-stroke directions.

With reference to FIGS. 1 and 9 more specifically, the apparatus and method for forming shingles on racks while applying heat and then cooling the shingles thus formed to retain their bent, formed shape is more clearly illustrated.

As shown toward the right side of FIG. 1, particularly in phantom, the robotic arm 47 engages a shingle precursor 33 from the trimming mechanism 50, delivering the same to the heat-applying rack station 51.

In the rack station 51, the robotic arm 47 places the shingle precursor 33 on racks 112 that, in turn, are disposed on a surface, such as an upper run 113 of a motor driven (not shown) movable conveyor belt 116, that may be shaft-mounted at 114, 115, with the upper run 113 adapted for rightward movement as shown, in the direction of the arrow 117. It will be understood that, in lieu of a robotic arm 47 the transfer of shingle precursors to the rack station 51 may be done manually.

The shingle precursors 33, when placed on the racks 112, will generally be protruding upwardly above the apex of each of the racks, as shown at the left end of the conveyor belt 116, in the rack station 51 of FIG. 1. Upon application of heat from a heating element 118 in the rack station 51, or upon prior heat applied thereto, the shingle precursors 33 may bend around the upper ends of the racks 112, in the direction of the arcuate arrows 120 shown in phantom in FIG. 1 such that the upper and right sides of the shingle precursors 33 drop downwardly via gravity, to conform to the right sides of the racks 112. It will be understood that heat may be applied via an electric resistance element 118 as shown, via radiant heating elements, conductive heating, or in any other form, within the rack station 51, or prior thereto, as may be desired.

With specific reference to FIG. 9, a representative rack 112 is shown, disposed on a surface, such as the upper run 113 of the conveyor belt 116, in substantially larger presentation than in FIG. 1. The rack 112 is shown to have left and right panels 121, 122, respectively, connected by a support 123, and the upper ends of the panels 121 and 122 merge in a cylindrical configuration 124, having a convex surface 125.

At the left end of FIG. 9, it will be seen that a pair of brackets 126, 127, engage against an upper surface 128 of the shingle precursor 33. It will be understood that the convex surface 125 of the rack 112 underlies the entire central zone 130 of the shingle precursor 33, between the lower and upper zones 131, 132 of the shingle precursor 33. It will also be understood that the thickness of the shingle precursor in zone 130, between its top surface 133 and bottom surface 134 is thinner than the thickness of the shingle precursor 33 in zones 131 and 132, such that, upon application of heat to a desired temperature, the material of the shingle precursor 33 in zone 130 will soften more quickly than that of the shingle precursor portions 131 and 132, such that weight of the upper portion 132 of the shingle precursor as shown in FIG. 9 will cause the bending of the shingle precursor in zone 130 about the convex surface 125 of the rack 112, causing such shingle precursor portion 132 to bend in the direction of the arcuate arrow 135, as shown in phantom, until the portion 132 of the shingle precursor 33 lies against the rack surface 122.

In one embodiment, the rack 112 may have an overall bend angle "a" inside its legs 121, 122, of 70° with a varying radius "r" from its axis 136 to its convex surface 125 from the far end 137, to the near end 138 of the shingle precursor 33, with the end 137 being the upper end of the headlap potion of the shingle when the shingle is finished, and with the near or lower end 138 being the lower end of the tab portion of the finished shingle.

As an additional example, an embodiment of the rack could have a radius "r" that is zero at the end 137 of the shingle precursor, corresponding to a tight fold at the upper end of the headlap portion of the shingle precursor placed thereon, with the radius "r" increasing along the shingle length between ends 137 and 138, for example of an 18 inch length of shingle, to a radius at the end 138 of about 2 inches, with an angle between surfaces 121 and 122 of the rack 112 being about 70°. Such would result in a shingle accessory of the hip, ridge or rake type that is shaped along its longitudinal axis between ends 137, 138 in zone 130 to have a narrow inside radius at end 137 and an internal radius of about 2 inches at end 138, with end 137 being the upper end of the headlap portion, and with the end 138 being the lower end of the tab or exposed portion of the shingle when the shingle is applied to a roof. In such an embodiment, depending upon the thickness of the bent shingle in zone 130, the external radius of the shingle at the point where a next-overlying shingle begins to overlap an underlying shingle, such external radius may, for example, be 2 inches, to promote nesting of an overlying shingle onto an underlying shingle without a producing a gap at the point where overlap begins, when installed on a roof It will also be understood that forming the shape of the shingle could be effected by other processes. For example, the hip, ridge or rake shingle could be injection molded to form a shingle with the desired compound bend radius along its length. In the case of a thermoplastic shingle, the hip, ridge or rake shingle could be initially formed by some other means such as calendering, stamping, compression molding, blow molding or other means known in the art for forming synthetic slate or shake shingles, and then subjected to a bending operation such as that described above. In yet another embodiment of the process, a preformed shingle precursor could be vacuum formed against a mold to take on the desired compound bend angle along the length of the hip, ridge or rake shingle.

It will also be understood that dimensions may be adjusted for varying roof situations. For example, for a 12 inch wide by 18 inch long shingle a rack has been described having an angle of 70° with a radius ranging from zero at the headlap end to 2 inches at the exposure or tab end, with the resulting shingle having an inner radius of 2 inches at the exposure end and an outer radius of 2 inches at the point of transition between the exposure zone and the headlap zone (where a next-overlying shingle begins to overly an underlying shingle) and an inner radius of about 1 half inch at the headlap end. For a hip, ridge or rake shingle, the interior angle of the two panel sections of the shingle could be from 60°-90°, and in some preferred embodiments more preferably between 60°-85°, while in other embodiments a preferred range would be a tighter range, between 65°-75°. In yet other embodiments more specific interior angles of about 70° and about 90° are preferred. In yet another embodiment, for a wider angled hip application, for example, the angle could be greater than 90° and in some instances the interior angle could have a range of 90° to 130°, with a preferred narrower range of 100°-120°, and in still other embodiments the preference would be an angle of about 110°. For forming the shingles, it is preferred that the radius of curvature at the bend of the headlap end is a tight radius such as a zero radius fold. In some embodiments, the radius at the headlap end could be about ¾ inches. For the radius at the exposure end of the shingle, a radius of about 2 inches is presently preferred, but the radius could be as low as about 1¼ inch or as great as about 2½ inches. If the radius is too large, gapping may occur at the point where a next-overlying shingle begins to overly an underlying shingle. It will further be understood that the various dimensions set forth above are by way examples only, and may change depending upon the size of the shingle body.

With specific reference now to FIG. 10, a composite rack assembly 140 is provided, having a plurality of shelves 141, in which a plurality of individual racks 112 are shown, in each case carrying a plurality of shingle precursors 33 disposed thereover, with the individual racks 112 being disposed on each of the shelves 141 in a pair of rows, both front and back. The composite assembly 140 may be automatically or manually, if desired, placed in a rack heating station 51 where the shingle precursors 33 are softened and formed over the racks 112 as described above with respect to FIG. 1. Thereafter, the composite rack assembly 140 may be delivered to a cooling station 150, as shown in FIG. 1, either by being conveyed thereto by means of a conveyor 116 as shown in FIG. 1, or manually delivered thereto, wherein a refrigerant or the like maybe delivered via cooling coils or the like 151, for receiving coolant into the station or chamber 150, and wherein a fan, or the like 152 may provide coolant air to the shingle precursors 33 therein, if desired. Alternatively, shingle precursors that have been heated and formed over racks 112 may be manually delivered to a composite rack assembly such as that shown in FIG. 10, to be removed from the station 51, to be allowed to cool in ambient air, for solidification of the shingle precursors, into formed shingles.

With specific reference to FIG. 11, it will be seen that a shingle 150' in accordance with this invention is provided, having an upper headlap end 151' and a lower tab end 152. The shingle 150 has left and right legs 157 and 158. In each leg, there is provided a cut-out 154 in the headlap portion, which joins the tab portion of the shingle in an arcuate cut-out 153. The shingle of FIG. 11 has an arc of approximately 70° between legs 157, 158 thereof. With more specific reference to FIG. 12, it will be seen that the radius 156 at the upper or headlap portion of the shingle is much tighter than the radius 155 shown in FIG. 11 for the outer edge of the tab portion of the shingle. The internal radius from one end to the other, of the shingle 150 varies gradually from the tight radius 156 at the upper end of the headlap portion, to the larger radius 155 shown at the end of the tab portion, in FIG. 11.

With specific reference to FIGS. 13 and 14, it will be seen that the larger radius 155 for the tab portion of the shingle is more readily apparent, as is the tighter radius 156 shown in FIG. 14 for the shingle 150.

With reference to FIGS. 15-17, the shingle 160 is shown to have an angle between legs 167, 168, of approximately 110°. The radius 165 at the outer or lower end of the tab portion of shingle is a much larger radius than the radius at the opposite end 161 of the shingle 160, with the internal radius between opposite ends of the shingle, varying gradually from the tighter radius 161 at the headlap end, to the larger radius 165 at the lower tab end of the shingle.

With reference now to FIGS. 18 and 19, an alternative embodiment 170 is shown for the shingle of this invention, likewise having an arcuate cutout 173 and cut back portion 174, and likewise having a gradually varying radius from the larger internal radius 175 at the outer end of the tab portion of the shingle, to an extremely tight or almost non-existent radius 172 at the end 171 of the shingle 170, with such variation in radii being gradual from the tight, almost non-existent radius 172 to that 175.

Referring now to FIG. 20 in detail, it will be seen that a roof 180 is shown in fragmentary illustration, having a plurality of shingles 187 applied to the sloped surfaces of the roof, and with an array 185 of shingles 182, 183 and 184 applied over the ridge of a roof, between a siding covered end 181 of the roof, and the opposite (not shown) end of the ridge. The illustration of FIG. 20 shows how next-overlying tab portions of the shingles will overly headlap portions of next-underlying shingles, such that the gradual change in radius from the upper end of the headlap portion of a shingle to the lower end of the tab portion of the shingle, being gradual, will allow the lower ends of tab portions of the shingles to tightly hug the upper surfaces of next-underlying shingles, so as to produce little or no vertical gap at locations 188 between shingles. Thus, the gradual taper in the bend of the shingles is such that it allows the shingles to overlap a next-underlying shingle in nested relation, with little or no gap between the shingles.

In the embodiments of the shingles of this invention, as addressed in FIGS. 11 through 19, it will be seen that the upper edges of the headlap portions are trimmed back at 154, 164 and 174 so that the widths of the shingles in the headlap zones are less than those in the tab or exposure zones. The matching angles of the outer radius of the bend of an underlying shingle near the upper end of the exposure zone and the inner radius of the bend of an overlying shingle at the lower leading edge of the exposure zone or tab portion help in making it easier to align the shingles along the hip or ridge.

It will thus be seen that, in the manufacturing process of the shingles of this invention, a coextruded plastic sheet conveys the shingle precursors onto a carrier plate and into a press where it is compression molded at 41 into a form that mimics a natural material, such as natural slate, cedar shake, or tile. The trimming mechanism 50 removes the excess material from the shingle and then the shingle is allowed to cool.

As addressed earlier herein, the carrier plate 27 used in accordance with this invention has a longitudinal center 62 that is slightly raised. This leaves the shingle precursor thinner at the bend than the portions of the shingle precursor on each side of the bend. This thinner area can, for example, be one half inch on each side of the longitudinal center line, for a total of a full one inch, in zone 130 of FIG. 9, for example. Thus, with reference to FIG. 9, the zone 130 can be, for example, 80 mils thick from top surface to bottom surface, as distinguished from perhaps 108 mils to 136 mils for zones 131 and 132 of the shingle precursor. The tapered zone from end 137 to end 138, for the shingle precursor shown in FIG. 9, for example, can extend outwardly from the central zone 130 for perhaps another 2 inches on each side of the central zone, prior to the shingle reaching a standard thickness, perhaps in the range of the 108 mils to 136 mils mentioned above.

With reference to FIGS. 11, 12, 15, 18 and 19, it will be noted that the trimming back of the edges 154, 164 and 174 in the headlap area, as well as the trimming back of the arcuate portions 153, 163 and 173, if desired, can be done after the shingle is cooled by an off-line trimmer (shown schematically at 190 in FIG. 1), if desired, to remove those portions of the headlap of the shingle. For example, a quarter-circle having a radius of ¾ inches can be removed, in the zones 153, 163, and 173, and then the cutback notches or cuts 154, 164 and 174 may be made, on each of the opposite edges of the shingles.

The trimmed-back headlap portions may then be heated, by placing the shingles on a forming rack and wheeled into an oven 51. In the oven, the shingle precursors, for example, in the case of a polypropylene material may bake at, for example, 347° F., for about 67 minutes. The temperature of the baking oven is sufficiently high that the overall shape of the shingle will drape over the rack as described above, conforming to the shape of the rack. The temperature and time cycle is not so extreme that the fine detail of the surface structure molded into the shingle precursor during the compression process is significantly affected. The temperature at the bend zone 130 reaches the softening or yield point, but not the melt point of the thermoplastic. The thinner part gets to the desired temperature more rapidly so that the shingle precursor bends at its center, but does not melt. The melt temperature of the shingle precursor may be about 320° F. While the oven is above the melt temperature, the shingle precursor reaches the yield point in the central portion 130 of the shingle precursor and it folds. The shingle precursors are removed from the heated zone 51 before the remainder of the shingle precursor melts, and the temperature actually reached by the shingle precursor is hot enough to soften the body of the shingle precursor, but not so hot that the features of the desired aesthetics are eliminated. The draping of the shingle precursor over the angled rack is not done with pressure, but only gravity, causing the fold after the thinner portion 130 of the shingle precursor softens. After the baking operation is completed, the shingle is removed from the oven and allowed to cool in the ambient before packaging, or is cooled as described above with respect to the apparatus 150 of FIG. 1.

It will be understood that in many instances the means for effecting movement of the shingles, the carrier plates, and the like, from one station to the other, are schematically shown, without showing all possible details of conveyors, walking beams, etc., and that other equivalents for such mechanisms may be provided. Similarly, with respect to the robot illustrated in FIG. 1, it will be understood that such mechanisms with varying extents of automation are available in the various mechanical arts, and can be used to mechanically move the shingle, carrier plates, and the like and that all equivalents of the same need not be disclosed herein.

The process as described herein may be applicable for providing an alternative to other types of molding techniques, such as injection molding techniques. With respect to some of these products, it may be desirable to add certain chemical features, such as fire resistance or fire retardant features, by adding materials that lend themselves to such features. Also, the carrier plates of this invention can enable molding of more than one part at a time. A common carrier plate could be provided with a thermoplastic material, and two or more molds could close in on the carrier plate, sandwiching the thermoplastic material therebetween, to make two or more parts simultaneously. Additionally, various sized tiles or shingles could be made on a single carrier plate. The process as described herein may be used for making either flat panels, or sheet, as well as tiles and shingles, from polymers as an alternative to injection molding, particularly where at least one side of the product is to have a texture emulating a natural material. The use of carrier plates as described herein can shorten the cycle time required for molding, by removing heat from partially molten material. The temperature of the carrier plate can reduce the material temperature and the charge or thermoplastic material can be reduced somewhat in temperature while the thermoplastic material is on the carrier plate, before it is molded. Also, cooling of the material can facilitate a shorter cycle time. Supporting the thermoplastic material that is to be molded on a carrier plate after molding can allow removal of the part from the mold sooner, also producing a shorter cycle time.

While the above invention has been described with respect to its use with thermoplastic materials, it will be understood that other materials can be used that lend themselves to molding, trimming and forming into the shape of hip, ridge and rake shingles, for use on roofs, including thermosetting materials.

It will be apparent from the foregoing that various modifications may be made in the details of construction, as well as in the use and operation of the process and apparatus of this invention, and in the details of shingle manufacture and carrier plate configuration, all within the spirit and scope of the invention as defined in the appended claims.

What is claimed is:

1. A hip, ridge or rake shingle for a hip, ridge or rake edge of a roof having at least two roof surfaces in different planes, wherein the planes intersect at an apex having an included angle that the hip, ridge or rake shingle is to cover, the shingle being of generally inverted "V" shaped configuration and of a given length between a headlap edge and an opposite leading edge and comprising:

a first side panel zone and a second side panel zone forming opposite sides of the inverted "V" shaped configuration joined along a central zone of the shingle, the central zone comprising an apex of an angle between the first and second side panel zones, the central zone further comprising a radius of curvature at the apex that varies along a length of the shingle from a first radius at a headlap edge of the shingle to a second radius at a leading exposed edge of the shingle, the second radius being larger than the first radius, with the first and second panel zones each terminating in free edges spaced apart from said central zone.

2. The shingle of claim 1, wherein the included angle between the first and second side panel zones is about 90°.

3. The shingle of claim 1, wherein the included angle between the first and second side panel zones is less than about 90°.

4. The shingle of claim 3, wherein the included angle between the first and second side panel zones is between about 60° and about 85°.

5. The shingle of claim 1, wherein the included angle between the first and second side panel zones is about 70°.

6. The shingle of claim 1, wherein the included angle between the first and second side panel zones is greater than about 90°.

7. The shingle of claim 1, wherein the included angle between the first and second side panel zones is between about 90° and about 130°.

8. The shingle of claim 1, wherein the included angle between the first and second side panel zones is about 110°.

9. An array of hip, ridge or rake shingles according to claim 1, wherein, the array comprises a first shingle underlying a second shingle, each shingle having an exposure zone and a headlap zone, the exposure zone having a lower leading edge and an upper edge, and wherein an outer radius on an outer surface of the first shingle at the upper edge of the exposure zone of the first shingle is approximately the same as the second radius on an inner surface of the second shingle.

* * * * *